US009039165B2

(12) United States Patent
Otsuka et al.

(10) Patent No.: US 9,039,165 B2
(45) Date of Patent: May 26, 2015

(54) RECORDING APPARATUS

(71) Applicant: SEIKO EPSON CORPORATION, Tokyo (JP)

(72) Inventors: Kazuo Otsuka, Azumino (JP); Sho Aruga, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/959,565

(22) Filed: Aug. 5, 2013

(65) Prior Publication Data

US 2014/0043419 A1 Feb. 13, 2014

(30) Foreign Application Priority Data

Aug. 8, 2012 (JP) ..... 2012-175757

(51) Int. Cl.
*B41J 2/01* (2006.01)
*B41J 13/03* (2006.01)
*B41J 3/407* (2006.01)

(52) U.S. Cl.
CPC ..... *B41J 13/03* (2013.01); *B41J 3/4071* (2013.01)

(58) Field of Classification Search
USPC ..... 347/104, 101
See application file for complete search history.

(56) References Cited

U.S. PATENT DOCUMENTS

| | | | | |
|---|---|---|---|---|
| 2,317,198 | A * | 4/1943 | Kasper | 72/51 |
| 5,594,486 | A * | 1/1997 | Kiyohara | 347/104 |
| 7,610,938 | B2 * | 11/2009 | Yanokura et al. | 138/170 |
| 2010/0209168 | A1 * | 8/2010 | Saito et al. | 400/578 |
| 2011/0195828 | A1 | 8/2011 | Taketsugu et al. | |

FOREIGN PATENT DOCUMENTS

| | | |
|---|---|---|
| JP | 2011-184198 | 9/2011 |

* cited by examiner

*Primary Examiner* — Henok Legesse
(74) *Attorney, Agent, or Firm* — Workman Nydegger

(57) ABSTRACT

A recording apparatus includes: a transporting roller which includes a cylindrical shaft having one joint from one end portion to the other end portion of the shaft and transports a recording medium by being driven to rotate; a driven roller which holds and transports the recording medium with the transporting roller; and a recording section which performs recording on the recording medium, in which the joint includes a plurality of protrusion sections which protrude in a direction intersecting with an axial direction of the transporting roller, in which the plurality of protrusion sections are disposed in positions which do not come into contact with both end portions of the recording medium in the axial direction of the cylindrical shaft.

9 Claims, 18 Drawing Sheets

RECORDING APPARATUS

BACKGROUND

1. Technical Field

The present invention relates to a recording apparatus represented by a facsimile, a printer or the like.

2. Related Art

In a recording apparatus such as a facsimile, a printer or the like, a medium transporting roller which transports a medium is provided in each location of a medium transporting path. Among the medium transporting rollers, in particular, a medium transporting roller provided on an upstream side of a recording unit that performs recording is made by forming a high friction layer on a peripheral surface of a solid metal shaft and, in addition, is made by forming a hollow cylindrical shaft using a metal plate material and by forming the high friction layer on the peripheral surface thereof as disclosed in JP-A-2011-184198.

The medium transporting roller disclosed in JP-A-2011-184198 is a cylindrical shaft formed by a metal plate material of which a pair of end portions facing each other are bonded and a concave-convex shaped engaging section (hereinafter, referred to as "a concave and convex engaging section" in this specification) is provided in a bonding section, thereby improving a mechanical bonding strength.

In a case where the concave and convex engaging section is provided, there is a concern that a corner portion of a front end of paper may be caught on the concave and convex engaging section when the front end of the paper passes through the medium transporting roller and there is a concern that the concave and convex engaging section may give damage to the paper when the paper passes through the concave and convex engaging section. Accordingly, in the recording apparatus disclosed in JP-A-2011-184198, the concave and convex engaging section is disposed outside a paper transporting region. However, in order to obtain further high accuracy and high durability by the medium transporting roller, in other words, from a viewpoint of a mechanical bonding strength, it is preferable that a plurality of concave and convex engaging sections be provided in an axial direction thereof.

SUMMARY

An advantage of some aspects of the invention is that it provides a recording apparatus including a medium transporting roller capable of realizing further high accuracy or high reliability while maintaining smooth transportation of paper or preventing damage to be given to the paper. For instance, the medium transporting roller in one embodiment can include a concave section, a convex section and a recess section, with the recess section being a gap in which an inlet corner portion of the concave section that is a peripheral portion thereof may recede so as not to interfere with a base section of the convex section when the concave section and the convex section engage with each other.

According to an aspect of the invention, there is provided a recording apparatus including: a transporting roller which includes a cylindrical shaft having one joint from one end portion to the other end portion of the shaft and transports a recording medium by being driven to rotate; a driven roller which holds and transports the recording medium with the transporting roller; and a recording section which performs recording on the recording medium, in which the joint includes a plurality of protrusion sections which protrude in a direction intersecting with an axial direction of the transporting roller, in which the plurality of protrusion sections are disposed in positions which do not come into contact with both end portions of the recording medium in the axial direction of the cylindrical shaft, in which at least one of the plurality of protrusion sections is disposed in a position which comes into contact with the recording medium between both of the end portions of the recording medium.

In this case, the recording medium transporting roller includes the cylindrical shaft having one joint from one end portion of the shaft to the other end portion of the shaft and the joint has the plurality of protrusion sections which protrude in the direction intersecting with the axial direction of the transporting roller. Then, since at least one of the plurality of protrusion sections is disposed in the position which comes into contact with the medium, a mechanical bonding strength can be further improved compared to a configuration in which the protrusion section is provided only outside the region coming into contact with the medium.

Then, since the protrusion sections are disposed in positions which do not come into contact with both end portions of the medium, in particular, the corner portion of front end can be prevented from being caught in the protrusion sections when the front end of the recording medium passes through the medium transporting roller. Accordingly, it is possible to provide the recording apparatus including the medium transporting roller capable of realizing further high accuracy or high reliability while maintaining smooth transportation of the recording medium.

In the recording apparatus, the joint may have a first gap in the most protruding part of the protrusion section in the axial direction.

One end surface and the other end surface of the plate material can comfortably engage with each other by having the first gap in the most protruding part of the protrusion section in the axial direction even though the plate material is configured by bending when forming the cylindrical shaft.

In the recording apparatus, the first gap may be provided in a direction intersecting with the axial direction of the transporting roller.

In this case, since the first gap is provided in the direction intersecting with the axial direction of the transporting roller, the front end of the recording medium of the recording medium is unlikely to be caught in the first gap and further smooth transportation can be realized.

In the recording apparatus, the joint may have a second gap in a position which is connected to an end portion of an opposite side to a protruding direction of the protrusion section.

Since the second gap is formed in the position which is connected to the end portion of the opposite side to the protruding direction of the protrusion section, the protrusion sections can be configured without interfering a peripheral portion in the cylindrical shaft, even though the plate material is configured by bending when forming the cylindrical shaft.

In the recording apparatus, the plurality of protrusion sections may be provided in a region which comes into contact with the recording medium in the transporting roller.

In this case, since the protrusion sections are provided in the region which comes into contact with the recording medium in the transporting roller, the strength of the transporting roller can be further improved.

According to another aspect of the invention, there is provided a recording apparatus including: a transporting roller which includes a cylindrical shaft having one joint from one end portion to the other end portion of the shaft and transports a recording medium by being driven to rotate; a driven roller which holds and transports the recording medium with the transporting roller; and a recording section which performs recording on the recording medium, in which the joint includes a plurality of protrusion sections which protrude in a direction intersecting with an axial direction of the transporting roller, in which the plurality of protrusion sections are disposed in positions which do not come into contact with the driven roller in the axial direction of the transporting roller, in which at least one of the plurality of protrusion sections is disposed in a position which comes into contact with the recording medium.

In this case, the recording medium transporting roller includes the cylindrical shaft having one joint from one end portion of the shaft to the other end portion of the shaft and the joint has the plurality of protrusion sections which protrude in the direction intersecting with the axial direction of the transporting roller. Since the plurality of protrusion sections are disposed in positions which do not come into contact with the driven roller, the protrusion sections can be prevented from giving damage to a peripheral surface of the driven roller. In addition, the protrusion sections do not give damage to the recording medium due to strong contact with each other when the recording medium is nipped by the transporting roller and the driven roller. Then, since at least a portion of the plurality of protrusion sections is disposed in a region which comes into contact with the recording medium, the mechanical bonding strength of the transporting roller can be further improved compared to a configuration in which the protrusion section is provided only outside the region coming into contact with the recording medium.

In the recording apparatus, the joint may have a first gap in the most protruding portion of the protrusion section in the axial direction.

One end surface and the other end surface of the plate material can comfortably engage with each other by having the first gap in the most protruding part of the protrusion section in the axial direction even though the plate material is configured by bending when forming the cylindrical shaft.

In the recording apparatus, the first gap may be provided in a direction intersecting with the axial direction of the transporting roller.

In this case, since the first gap is provided in the direction intersecting with the axial direction of the transporting roller, the front end of the recording medium is unlikely to be caught in the first gap and further smooth transportation can be realized.

In the recording apparatus, the joint may have a second gap in a position which is connected to an end portion of an opposite side to a protruding direction of the protrusion section.

Since the second gap is formed in the position which is connected to the end portion of the opposite side to the protruding direction of the protrusion section, the protrusion sections can be configured without interfering a peripheral portion in the cylindrical shaft, even though the plate material is configured by bending when forming the cylindrical shaft.

In the recording apparatus, the plurality of protrusion sections may be provided in a region which comes into contact with the recording medium in the transporting roller.

In this case, since the plurality of protrusion sections are provided in the region which comes into contact with the recording medium in the transporting roller, the strength of the transporting roller can be further improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described, based on the drawings. The invention is not limited to the embodiment and various modifications may be possible within a range of the invention described in aspects thereof. In addition, on an assumption that the modifications are also intended to be included in the range of the invention, hereinafter, an embodiment of the invention will be described.

Figure 1:
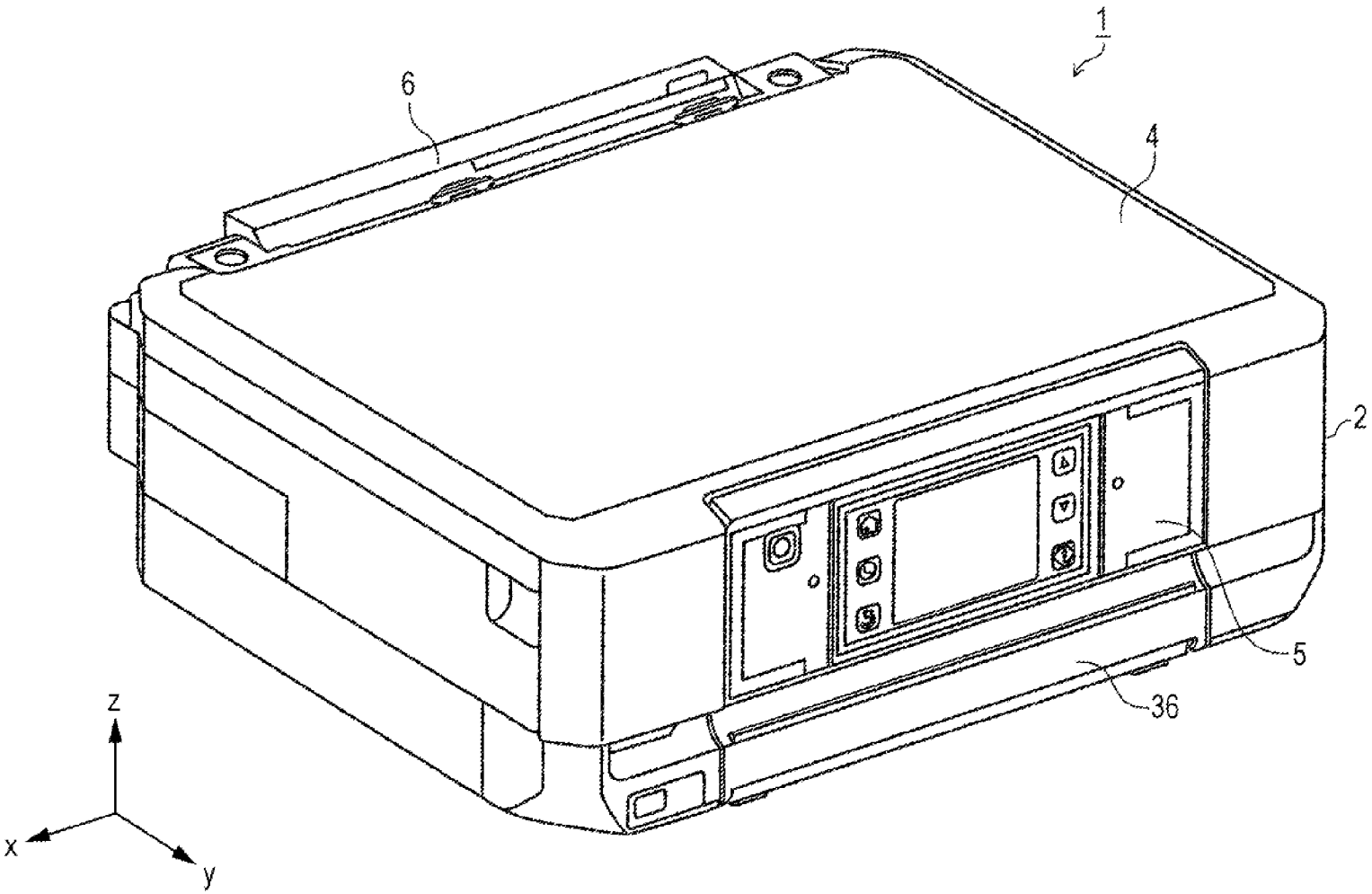
FIG. 1 is an external perspective view of a printer according to the invention.
Figure 2:
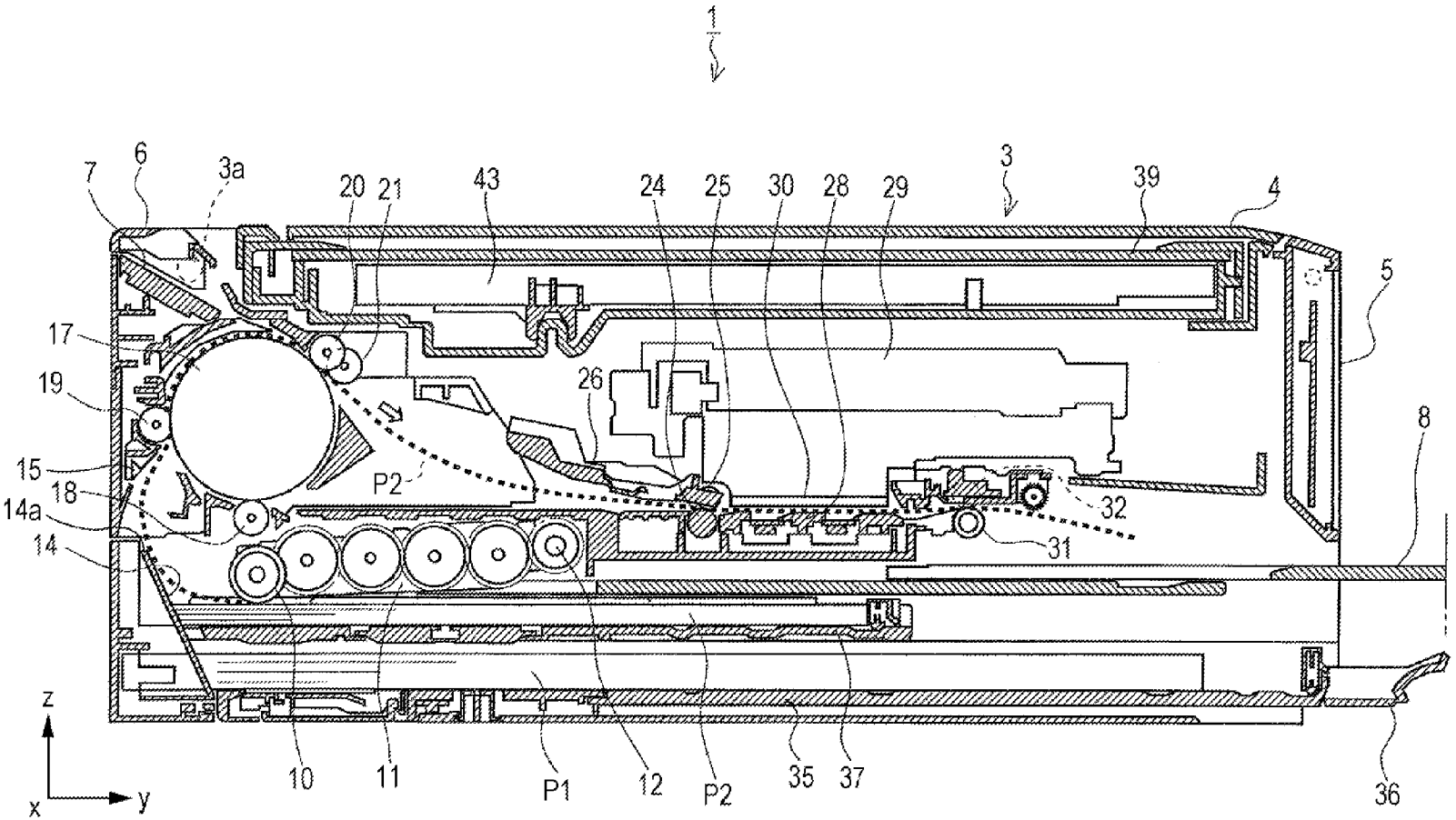
FIG. 2 is a side cross-sectional view illustrating the paper transporting path of a printer according to the invention.
Figure 3:
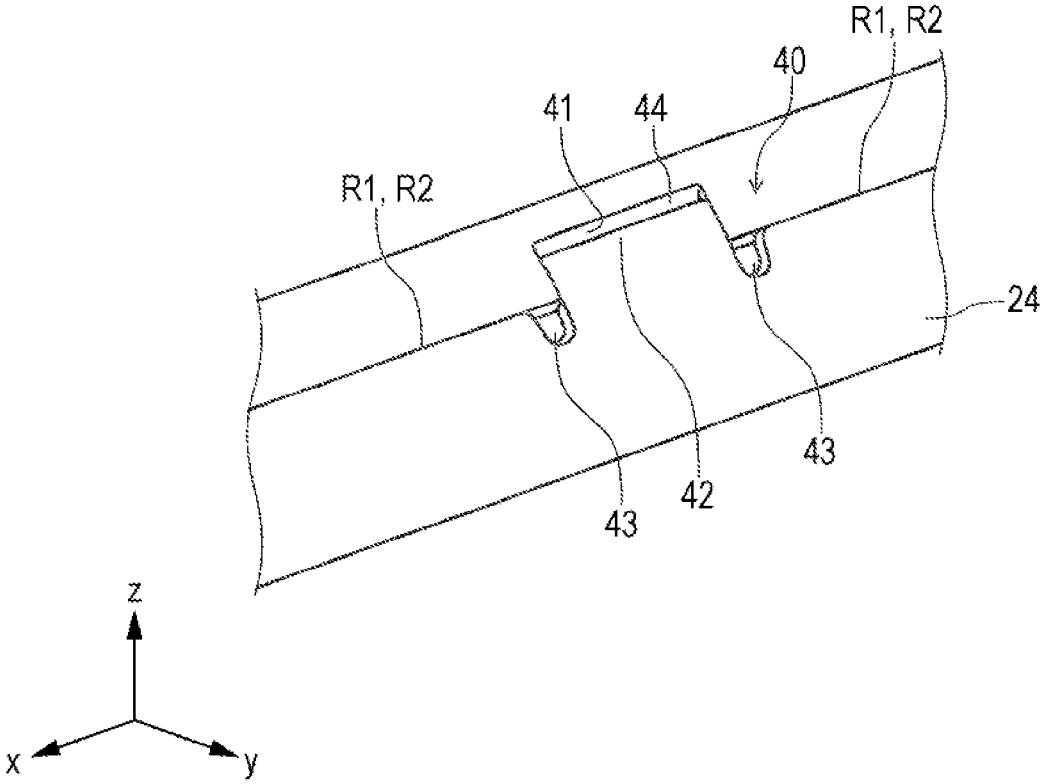
FIG. 3 is a perspective view of a concave and convex engaging section of a transport driving roller according to a first embodiment.
Figure 4A:
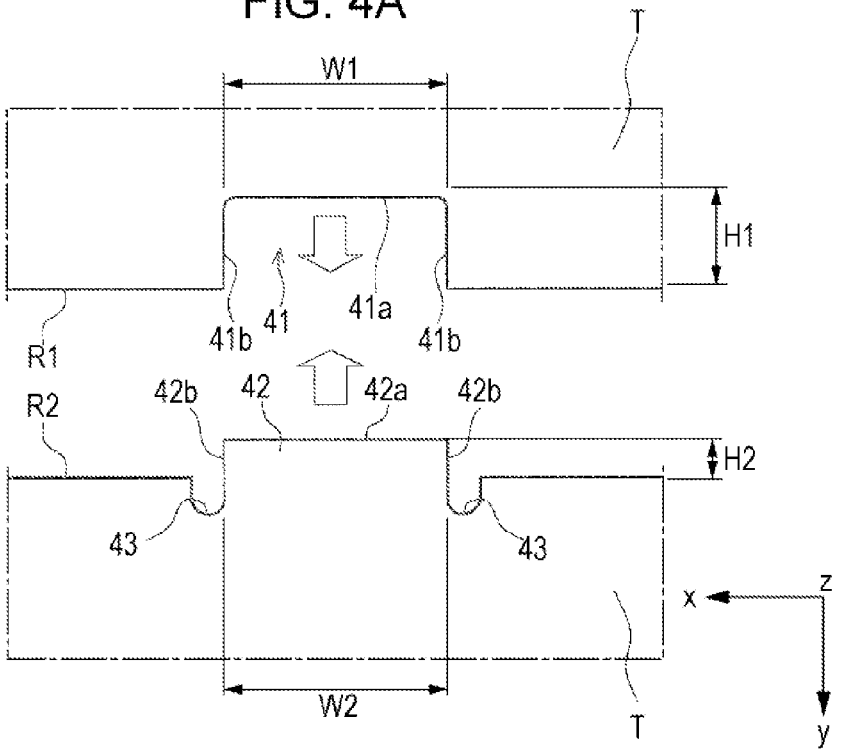
FIGS. 4A and 4B are plan views of the concave and convex engaging section of the transport driving roller according to the first embodiment.
Figure 4B:
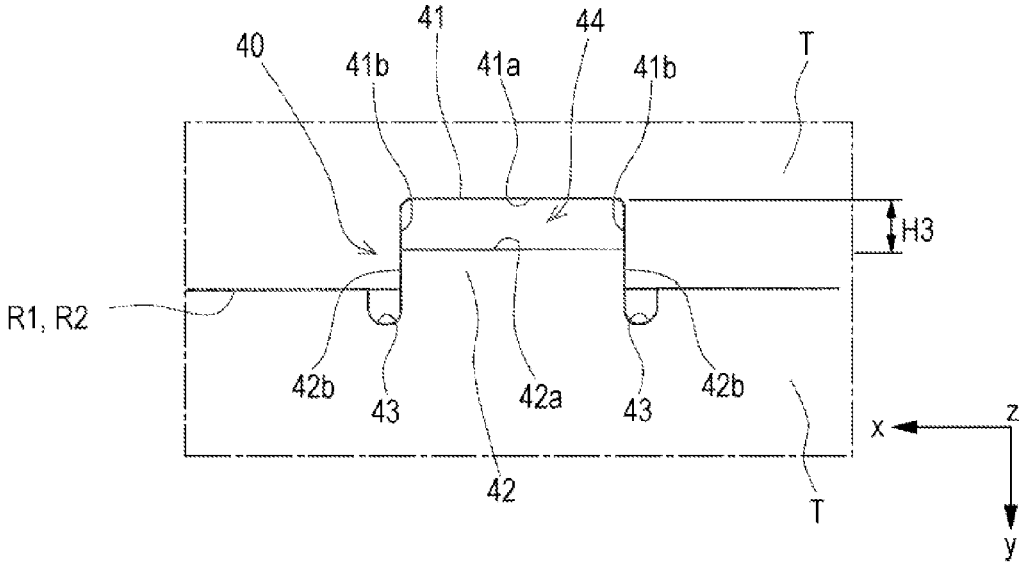
Figure 5:
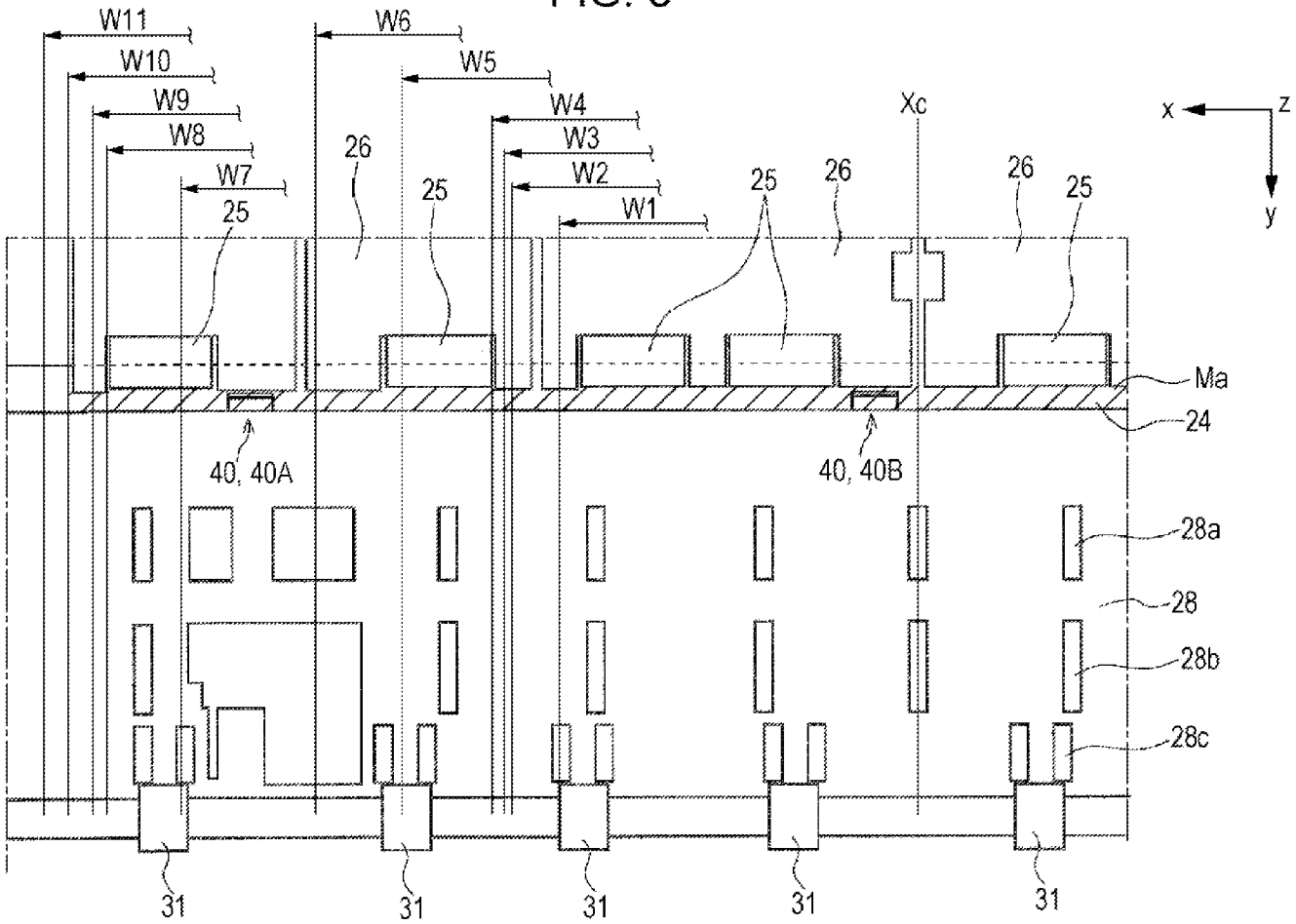
FIG. 5 is a plan view illustrating arrangement positions of the concave and convex engaging sections of the transport driving roller according to the first embodiment.

FIG. 1 is an external perspective view of an ink jet printer (hereinafter, referred to as a printer) 1 as an embodiment of a recording apparatus according to the invention, FIG. 2 is a side cross-sectional view illustrating a paper transporting path of the printer 1, FIG. 3 is a perspective view of a concave and convex engaging section 40 of a transport driving roller 24 according to a first embodiment, FIGS. 4A and 4B are plan views of the concave and convex engaging section 40, and FIG. 5 is a plan view illustrating arrangement positions of the concave and convex engaging sections 40.

Figure 6:
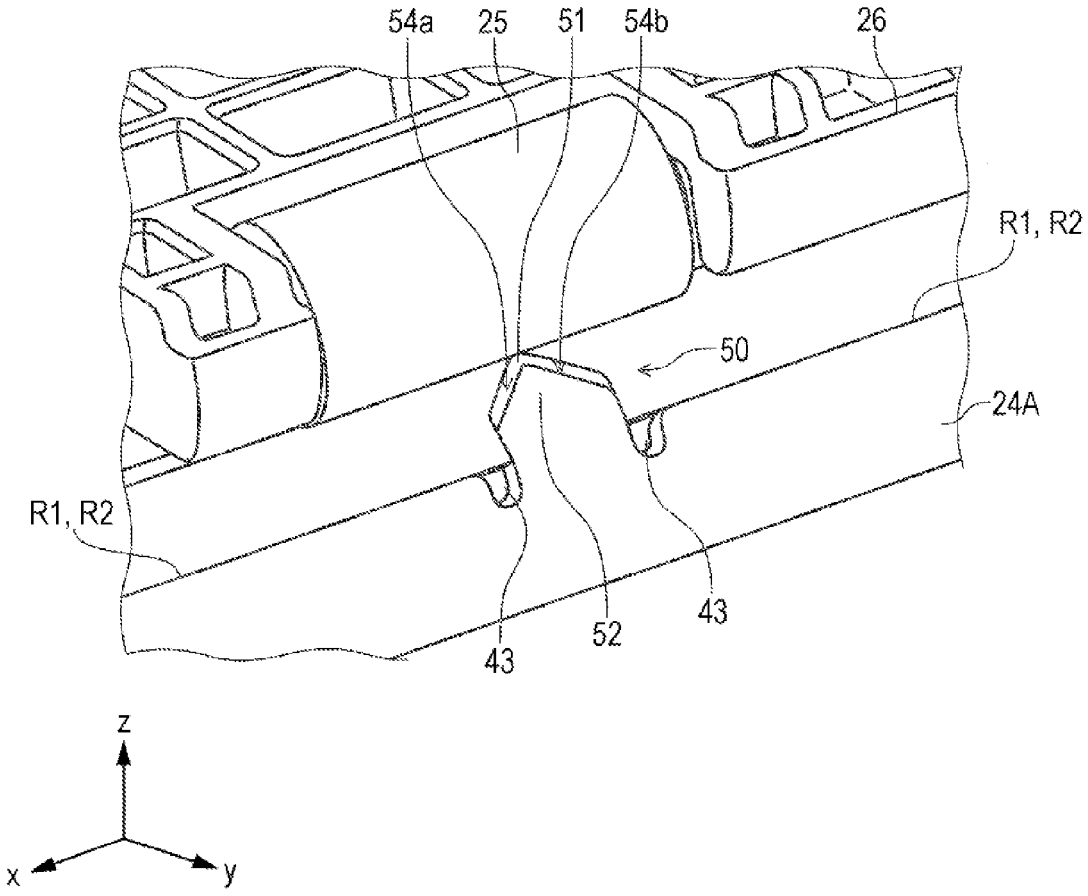
FIG. 6 is a perspective view of a concave and convex engaging section of a transport driving roller according to a second embodiment.
Figure 7A:
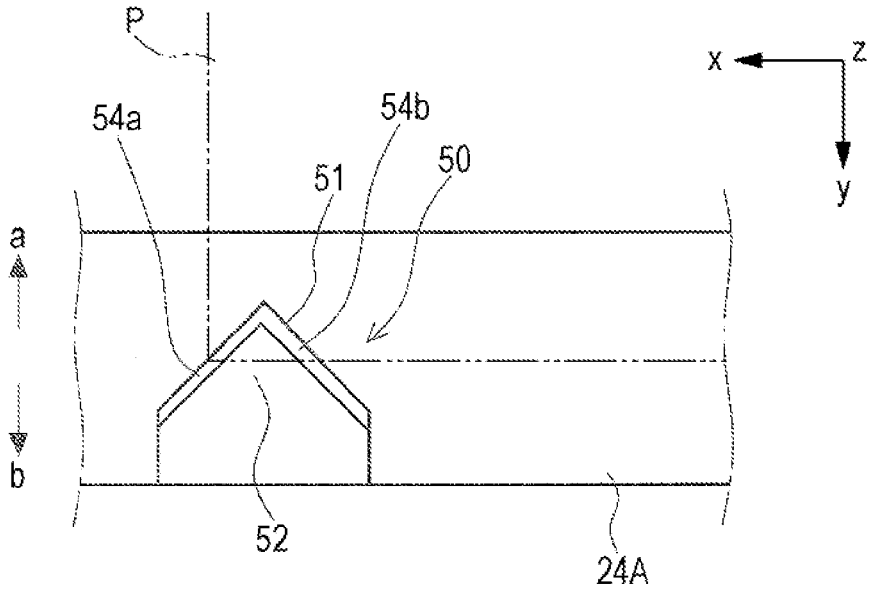
FIG. 7A is a plan view of the concave and convex engaging section according to the second embodiment and FIG. 7B is a plan view of a concave and convex engaging section according to a third embodiment.
Figure 7B:
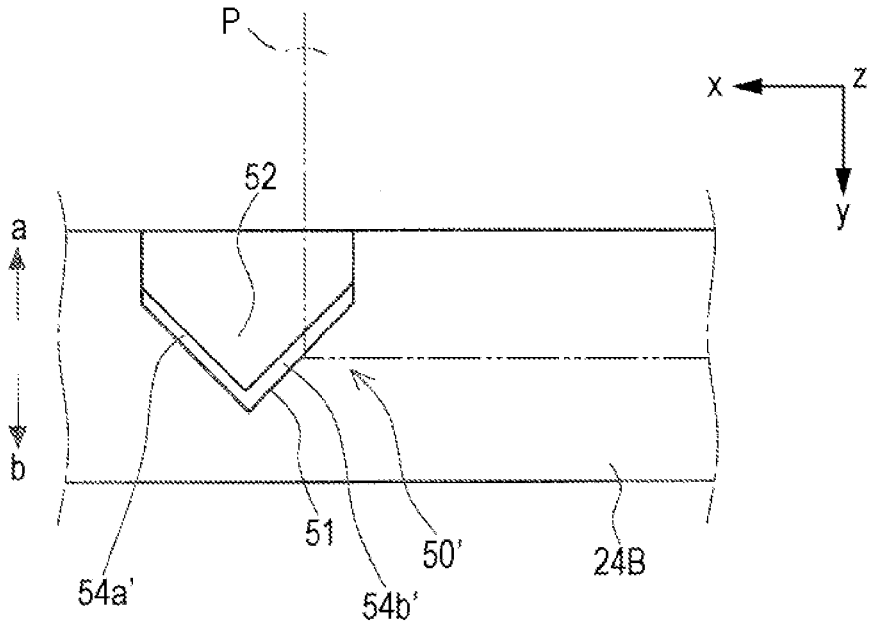
Figure 8A:
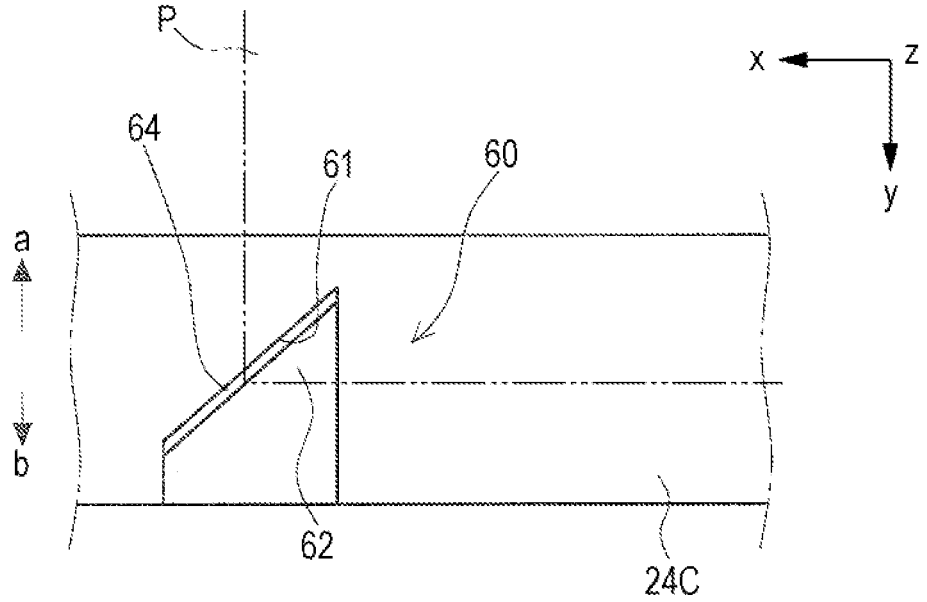
FIG. 8A is a plan view of a concave and convex engaging section according to a fourth embodiment and FIG. 8B is a plan view of a concave and convex engaging section according to a fifth embodiment.
Figure 8B:
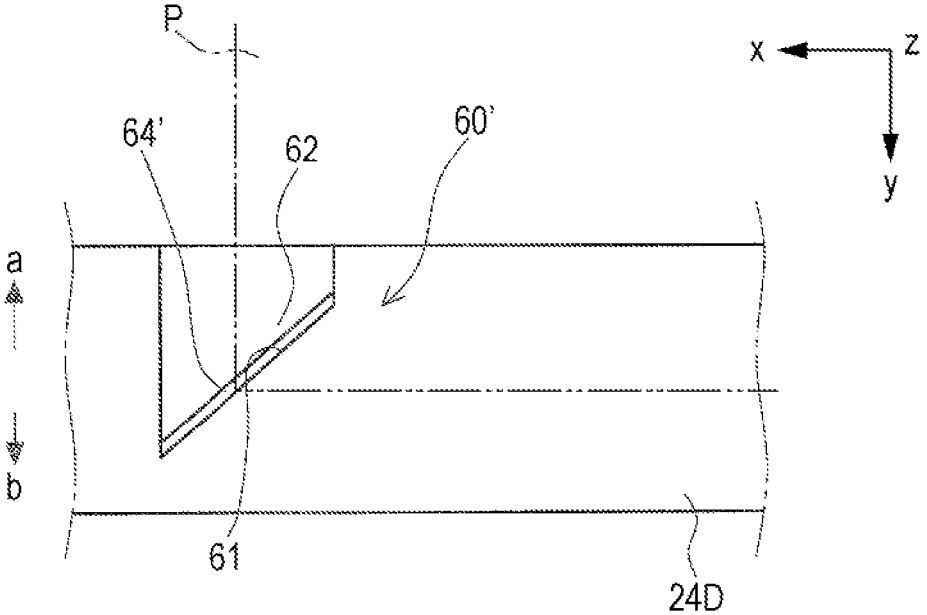

In addition, FIG. 6 is a perspective view of a concave and convex engaging section 50 according to a second embodiment, FIG. 7A is a plan view of the concave and convex engaging section 50, FIG. 7B is a plan view of the concave and convex engaging section 50' according to a third embodiment, FIG. 8A is a plan view of a concave and convex engaging section 60 according to a fourth embodiment, FIG. 8B is a plan view of a concave and convex engaging section 60' according to a fifth embodiment, and FIGS. 9A to 9C and FIGS. 10A to 10C are schematic diagrams illustrating a manufacturing process of a transport driving roller 24.

Furthermore, an x-direction is a width direction of an apparatus (unit), a y-direction is a depth direction of the apparatus (unit) and a z direction is a height direction of the apparatus (unit) in an x-y-z coordinate system illustrated in each of FIGS. 1 to 8B and FIGS. 18 to 20. In the y-direction that is the depth direction of the unit, a front side of the apparatus (unit) is a side in which an operation panel 5 is provided and a rear side of the apparatus (unit) is an opposite direction thereof. Furthermore, some configuration elements of the printer 1 are appropriately omitted in FIGS. 1 to 20.

Hereinafter, first, an entire configuration of the printer 1 is outlined. The printer 1 is configured as an ink jet multifunction printer which includes a scanner unit 3 to be rotatable on an upper portion of a recording unit 2 performing ink jet recording on a recording paper that is an example of a recording medium, in other words, includes a scanner function in addition to an ink jet recording function.

The scanner unit 3 is rotatably connected to the recording unit 2 through a rotation shaft 3*a* (FIG. 2) and can take a closed state (FIG. 1) and an open state (not illustrated) by rotating.

A document cover 4 at the upper portion of the scanner unit 3 is a cover which is capable of opening and closing, and a document platen 39 (FIG. 2) of the scanner unit 3 is adapted to appear by opening the document cover 4.

A reference numeral 5 in the front surface of the apparatus is an operation panel as a tilt section which is configured by including a power supply button, operation buttons performing various print setting and recording performance, a display section performing print setting content or preview of a print image, or the like. The operation panel 5 is provided at a front surface of surfaces (the front surface, a right side surface, a left side surface and a rear surface) forming a periphery of the recording unit 2.

The operation panel 5 is configured to be tiltable and is adapted to be adjusted to an angle at which a user easily operates. Furthermore, an open angle of the operation panel 5 is held by an angle holding unit (not illustrated) and the angle thereof is adapted to be held even when receiving an external force in a closing direction to operate the buttons.

A reference numeral 36 in the front surface of the apparatus is an openable and closable cover provided in a lower side tray 35. FIG. 1 illustrates a closed state of the cover 36, FIG. 2 illustrates an open state of the cover 36, respectively. Then, the lower side tray 35, an upper side tray 37 and the discharged-paper receiving tray 8 can be exposed by opening the cover 36, and a detaching work of the lower side tray 35 or the upper side tray 37 can be performed.

The discharged-paper receiving tray 8 is provided so as to be displaceable when slid between a storage position (FIG. 1) stored in the recording unit 2 and a protrusion position (FIG. 2) protruded to the front side of the recording unit 2 by a motor (not illustrated). The recording paper which is discharged by performing recording may be received by the discharged-paper receiving tray 8 taking up the protrusion position protruded to the front side of the recording unit 2.

The lower side tray 35 and the upper side tray 37 provided on the upper portion thereof are capable of storing a plurality of sheets of recording paper, and are detachably provided, individually in the recording unit (the apparatus body) 2. The above-described cover 36 is rotatably provided on the lower side tray 35.

Subsequently, a reference numeral 6 in the rear upper portion of the recording unit 2 is an openable manual cover and paper feeding of the recording papers is performed manually using a manual tray 7 (FIG. 2) by opening the manual cover 6.

Subsequently, the paper transporting path of the printer 1 is described mainly with reference to FIG. 2. The printer 1 according to the embodiment includes the lower side tray 35 and the upper side tray 37 at the bottom of the apparatus, and the recording paper is fed by one sheet at a time from the lower side tray 35 or the upper side tray 37.

The upper side tray 37 is provided so as to be displaceable by sliding between a feedable position (FIG. 2) and a retracted position (not illustrated), and is configured to be displaced between the feedable position and the retracted position by receiving the power from a motor (not illustrated).

In addition, in the FIG. 2, paper stored in the lower side tray 35 is illustrated in a reference numeral P1 and paper stored in the upper side tray 37 is illustrated in a reference numeral P2, respectively (hereinafter, if there is no particular need to distinguish the trays, referred to as "paper P").

A feeding roller (also referred to as a pick-up roller) 10 which is driven to rotate by a motor (not illustrated) is provided on an oscillation member 11 oscillating about a rotation shaft 12. When the upper side tray 37 slides to the most front side (the right side in FIG. 2: a drawing-out direction side of the upper side tray 37) of the apparatus, in other words, when the upper side tray 37 is in the retracted position (not illustrated), the uppermost paper P1 is delivered from the lower side tray 35 by rotating while coming into contact with the uppermost paper of the paper P1 stored in the lower side tray 35.

In addition, when the upper side tray 37 is in a contact position by sliding to the most rear side (the left side in FIG. 2: a mounting direction side of the upper side tray 37 and a paper delivery direction side) of the apparatus, in other words, in the feedable position of the upper side tray 37 (the state illustrated in FIG. 2), the uppermost paper P2 is delivered from the upper side tray 37 by rotating the feeding roller 10 while coming into contact with the uppermost paper of the paper P2 stored in the upper side tray 37. In addition, a broken line in FIG. 2 illustrates a passing trace of the paper P2 delivered from the upper side tray 37.

Subsequently, a separation slope 14 is provided in a position facing the front ends of the lower side tray 35 and the upper side tray 37. The paper P delivered from the lower side tray 35 or the upper side tray 37 advances downstream while the front end thereof comes into contact with the separation slope 14 and then the uppermost paper P to be fed separates from the rest of paper P.

A reverse roller 17 which is driven to rotate by a motor (not illustrated) is provided ahead of the separation slope 14. The paper P is bent to be converted and faces towards the front side of the apparatus by the reverse roller 17. In addition, reference numerals 18, 19, 20 and 21 are driven rollers which are driven to rotate and at least the paper P delivered from each tray is nipped by the driven roller 19 and the reverse roller 17. In addition, the paper P is nipped by the driven roller 20 and the reverse roller 17 and then is transported to the downstream side.

A transport driving roller 24 as "a medium transporting roller" which is driven to rotate by a motor (not illustrated) and a transport driven roller 25 as "a driven roller" which is driven to rotate by coming into contact with the transport driving roller 24 are provided ahead of the reverse roller 17, and the paper P is transported under the recording head 30. The transport driven roller 25 is freely and rotatably pivoted in a roller holder 26. In this embodiment, the transport driving roller 24 is configured by attaching wear resistance particles (not illustrated) on a front surface of a long shaft body in the width direction of the paper. In addition, the transport driving roller 24 is formed by a hollow shaft (cylindrical shaft) which is processed into a cylindrical shape from a metal plate material and is described below in detail.

Subsequently, the recording head 30 which configures a recording section performing the recording and ejects ink is provided on the bottom portion of the carriage 29. The carriage 29 is driven to reciprocate in a scanning direction (x-direction: front and rear direction of a paper surface in FIG. 2) of the recording head 30 by a motor (not illustrated).

A support member 28 is provided in a position facing the recording head 30 and an interval between the paper P and the recording head 30 is defined by the support member 28. In addition, as illustrated in FIG. 5, ribs 28*a*, 28*b* and 28*c* extending in the transportation direction of the paper are disposed on the upper surface of the support member 28 at a predetermined interval in the transportation direction of the paper. The ribs 28*a*, 28*b* and 28*c* are disposed at the predetermined intervals in the width direction of the paper. The paper is supported by the ribs 28*a*, 28*b* and 28*c*.

Then, the downstream side of the support member 28 has a discharge unit including a discharge driving roller 31 which is driven to rotate by a motor (not illustrated) and a discharge driven roller 32 which is driven and rotated by coming into contact with the discharge driving roller 31. The paper P on which recording is performed by the recording head 30 is discharged toward the discharged-paper receiving tray 8 described above by these rollers.

Subsequently, manufacturing method of the transport driving roller 24 will be described with reference to FIGS. 9A to 9C and FIGS. 10A to 10C. The transport driving roller 24 is formed by processing the metal plate material into a cylindrical shape as described above and the processing mainly includes a press processing of the metal plate material, a cylinder processing of the plate material which is obtained by the press processing and an adhering processing of a high-friction region configured of wear-resistant particles on the surface of the cylindrical shaft obtained by the cylinder processing. The portion in which the high-friction region is formed is illustrated as a high-friction layer Ma in FIG. 5. The high-friction layer Ma is applied in a region to nip the recording medium with the transport driven roller 25 and the transport driving roller 24. In addition, the high-friction layer Ma may be applied throughout the above described nip region and does not necessarily need to be applied on the surface of the transport driving roller 24 in a region which is outside from the nip region in the transport driving roller 24.

FIGS. 9A to 9C and FIGS. 10A to 10C are side views illustrating cylinder bending processing using a press machine. Approximately, a flat plate section 70 of a plate material T is bent and processed so that bonding sections R1 and R2 which are end surfaces of both sides of the flat plate section 70 are brought closer together using a press. Then, as illustrated in FIGS. 9A to 9C and FIGS. 10A to 10C, a cylindrical shape is formed by the pair of end surfaces being opposed and brought to be engaged together.

Figure 9A:
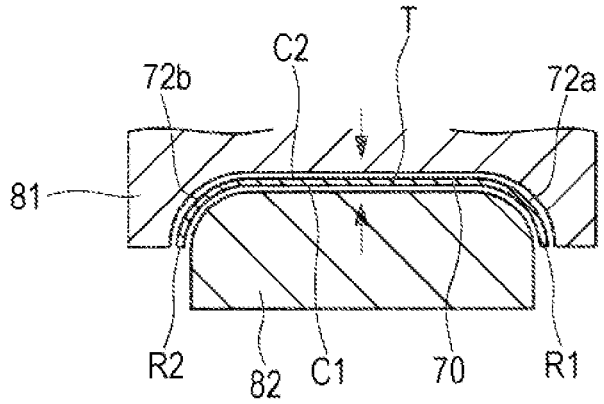
FIGS. 9A to 9C are schematic diagrams illustrating a manufacturing process of a transport driving roller.

Specifically, first, the flat plate section 70 of the plate material T is pressed by a female mold (bending die) 81 and a male mold (bending punch) 82 as illustrated in FIG. 9A, and both end portions 72*a* and 72*b* of the flat plate section 70 are bent into an arc shape (desirably approximately a ¼ arc). In addition, in order for each member to be easily understood in FIG. 9A, the members are described with a gap between the flat plate section 70, the female mold 81, and the male mold 82, respectively, but the gap does not exist in reality and the flat plate section 70, the female mold 81, and the male mold 82 are substantially in close contact with each of the contact portions. This is the same for FIGS. 9B to 9C and FIGS. 10A to 10C described later.

Figure 9B:
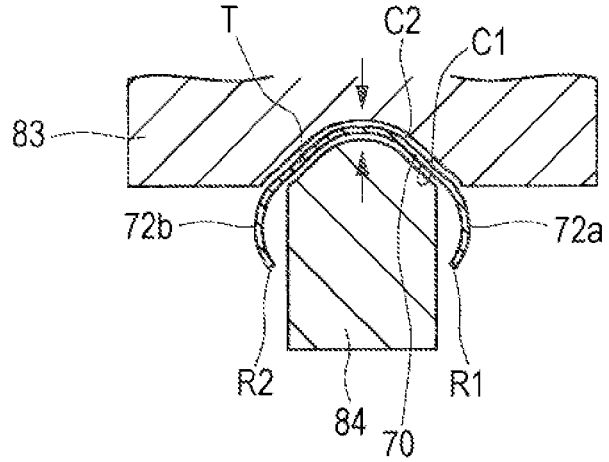
Figure 9C:
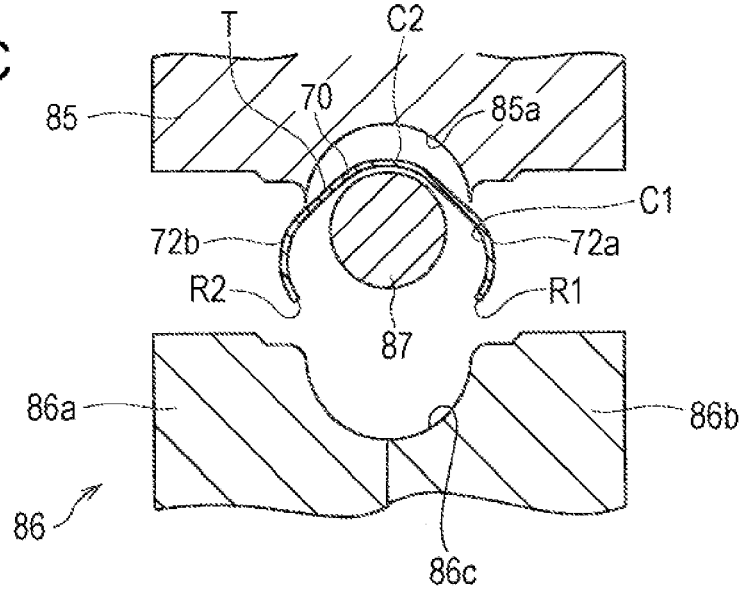

Here, the male mold 82 is arranged so as to face a surface of a lower side of the flat plate section 70 in FIGS. 9A to 9C. In addition, the female mold 81 is arranged so as to face a surface of an upper side of the flat plate section 70 in FIGS. 9A to 9C. Therefore, both of the end portions 72*a* and 72*b* of the flat plate section 70 are bent and processed into an arc shape toward a surface C1 side.

Next, after the plate material is transported in one direction, a central portion in a short-side direction (a bending direction) of the flat plate section 70 is pressed by a second female mold (a bending die) 83 and a second male mold (a bending punch) 84 as illustrated in FIG. 9B. Then, the central portion of the flat plate section 70 is bent into an arc shape (desirably approximately a ¼ arc) toward the surface C1 side.

Next, after the plate material is transported in one direction, a core mold 87 is arranged at an inner side of the flat plate section 70 as illustrated in FIG. 9C. Then, as illustrated in FIGS. 10A to 10C, each of the end surfaces R1 and R2 of both of the end portions 72*a* and 72*b* of the plate material T are brought closer together using an upper mold 85 and a lower mold 86 illustrated in FIG. 9C.

Figure 10A:
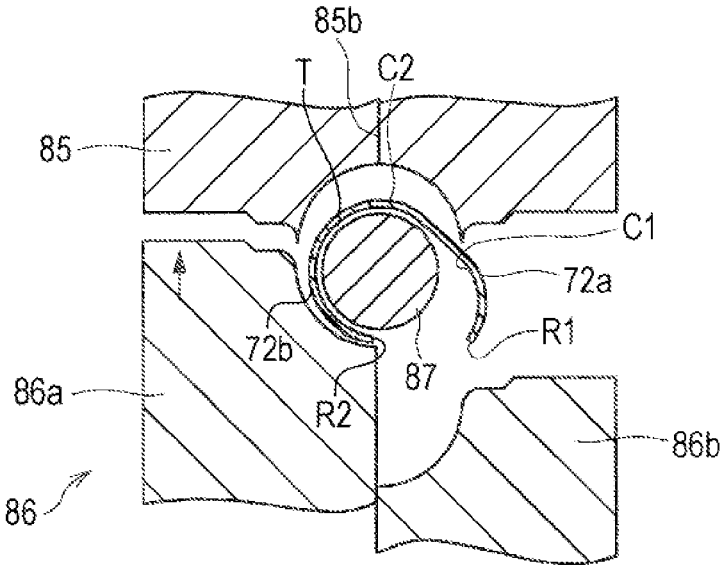
FIGS. 10A to 10C are schematic diagrams illustrating the manufacturing process of the transport driving roller.
Figure 10B:
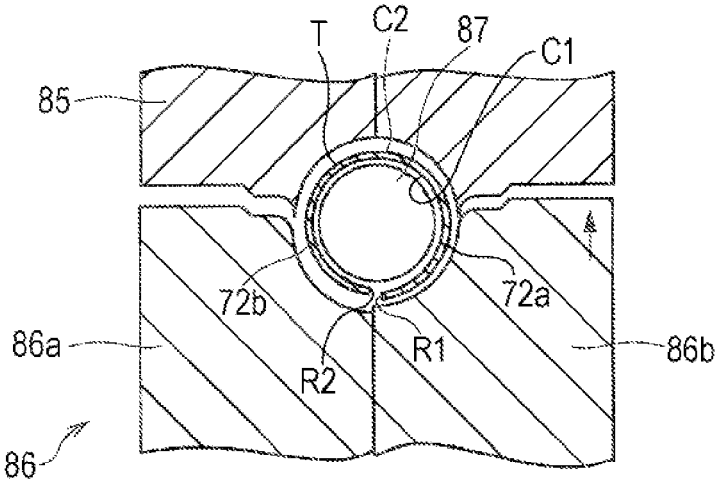
Figure 10C:
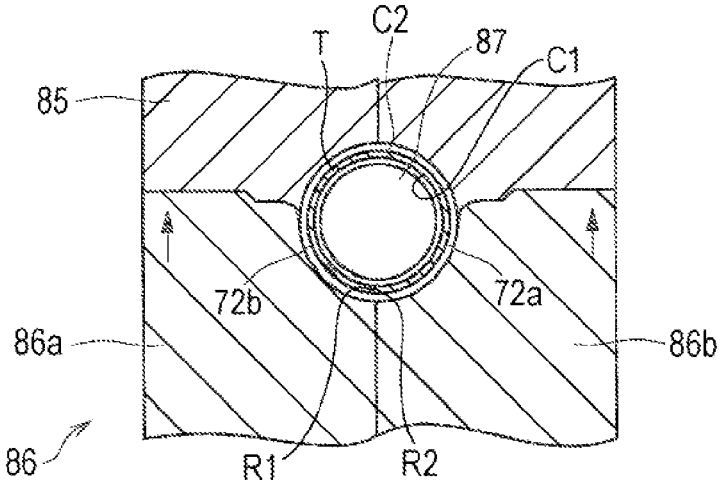

Here, the outer diameter of the core mold 87 illustrated in FIG. 9C and FIGS. 10A to 10C is equal to the inner diameter of the transport driving roller 24 having a hollow cylindrical shape to be formed. In addition, as illustrated in FIG. 9C, the radius of a press surface 86*c* of the lower mold 86 and the radius of a press surface 85*a* of the upper mold 85 are each equal to the radius of the outer diameter of the transport driving roller 24 when polishing has been factored in. Furthermore, as illustrated in FIGS. 10A to 10C, the lower mold 86 is a pair of left and right split molds, and the split molds 86*a* and 86*b* are configured to be independently movable upward and downward, respectively.

That is, from a state illustrated in FIG. 9C, the left-side split mold 86*a* is brought close to the upper mold 85 as illustrated in FIG. 10A, one side of the plate material T is press processed and is bent into approximately a semicircle shape.

In addition, the upper mold 85 may be a pair of left and right split molds similar to the lower mold 86 (see the split surface 85*b*) and the upper mold in the same side may be brought close to the split mold 86*a* when performing the processing illustrated in FIG. 10A.

Next, as illustrated in FIG. 10B, the core mold 87 is moved slightly to the upper mold 85 side (to an extent that it is possible that the one side end surface R1 and the other side end surface R2 are brought closer together), the other side split mold 86*b* is brought close to the upper mold 85 and the other side of the plate material T is press processed, and bent into approximately a semicircle shape.

After that, as illustrated in FIG. 10C, the core mold 87 and the pair of split molds 86*a* and 86*b* are brought close to the upper mold 85 and the transport driving roller (hollow pipe)

24 having a cylindrical shape is formed. In this state, both the left and right sides of the end surfaces R1 and R2 are in a state of opposing each other and being brought to be engaged together.

That is, in the transport driving roller 24 having the cylindrical shape, the end surfaces R1 and R2 of the plate material T which is a substrate are brought close to each other and a joint is formed between the end surfaces R1 and R2. The joint is formed from one end to the other end of the transport driving roller 24 in the axial direction. Here, a surface C1 becomes an inner peripheral surface of the transport driving roller 24 and a surface C2 becomes an outer peripheral surface of the transport driving roller 24. In this manner, the plate material T wraps around the core mold 87 and the transport driving roller 24 is formed by meshing the concave and convex engaging section 40 described below. In addition, the end surfaces R1 and R2 are brought close to or come into contact with each other and form the bonding section, and a result of the meshing of the concave and convex engaging section 40 described above contributes to improve strength of the transport driving roller 24, in particular, a distortion strength thereof.

First Embodiment

Subsequently, the concave and convex engaging section 40 that is a first embodiment of the concave and convex engaging section will be described in detail with reference to FIGS. 3 to 5. The concave and convex engaging section 40 is a concave and convex engaging section which is formed by engaging with a concave section 41 and a convex section 42 as an protrusion section which are formed in the pair of end portions R1 and R2 of the plate material T, respectively, and the concave section 41 and the convex section 42 are engaged by bonding of the end portions R1 and R2 using cylindrical bending processing of the above described plate material T (FIGS. 4A and 4B).

The concave section 41 formed in the end portion R1 has a shape that a bottom portion 41*a* is parallel to a rotation axis direction (the x-direction) of the roller and side portions 41*b* and 41*b* are parallel to a direction (the y-direction) orthogonal to the rotation axis direction when the concave section 41 is assembled in the printer 1 as the transport driving roller 24. In addition, the convex section 42 formed in the end portion R2 has a shape that a top portion 42*a* is parallel to the rotation axis direction (the x-direction) of the roller and side portions 42*b* and 42*b* are parallel to the direction (the y-direction) orthogonal to the rotation axis direction when the convex section 42 is assembled in the printer 1 as the transport driving roller 24.

A width W1 of the concave section 41 is formed slightly greater than a width W2 of the convex section 42, both are set in dimensional relationships which enable the concave section and the convex section to engage with each other and, at the same time, the width W1 and the width W2 are set so that a gap is not formed between the side portion 41*b* of the concave section 41 and the side portion 42*b* of the convex section 42, when both engage with each other.

A depth H1 of the concave section 41 is formed greater than a height H2 of the convex section 42, the depth H1 and the height H2 are set so that a gap 44 (a dimension H3) as a first gap is formed between the bottom portion 41*a* of the concave section 41 and the top portion 42*a* of the convex section 42 when both engage with each other. In a case of H1<H2 due to a manufacturing tolerance while setting the depth H1 and the height H2 to form the gap 44, the pair of end portions R1 and R2 cannot be bonded when the cylindrical bending processing of the plate material T is performed. Thus, the first gap is provided at the most protruding position in a direction intersecting with the end surfaces R1 and R2 in the convex section 42.

A reference numeral 43 is a recess section as a second gap in which an inlet corner portion of the concave section 41 that is a peripheral portion thereof may recede so as not to interfere with a base section of the convex section 42 when the concave section 41 and the convex section 42 engage with each other. The recess section 43 is provided at a position to which the pair of end portions R1 and R2 are connected in an end portion opposite to the protrusion direction of the convex section 42 and has a gap. Furthermore, it is preferable that the recess section 43 be arranged at a position which does not come into contact with the end portion of the recording paper in the paper width direction and according to the configuration, there is no possibility that the recording paper is caught in the recess section.

The strength of the transport driving roller 24, in particular, the distortion strength thereof is improved by providing a plurality of concave and convex engaging sections 40 along the rotation axis direction of the transport driving roller 24 described above. Here, the concave and convex engaging section 40 in the embodiment is arranged at the position which does not come into contact with both end portions of the paper in the region coming into contact with the paper. FIG. 5 illustrates such an arrangement state and a position Xc is a center position in the paper width direction, which is common in the sheets of paper of various standard sizes which are expected to be used in the printer 1.

Then, reference numerals W1 to W11 illustrate widths of various sized sheets of paper described above. For example, W1 is an L format photo size (89 mm), W2 is a postcard size (100 mm), W3 is a 4×6 format photo size (101.6 mm), W4 is an A6 size (105 mm), W5 is a 2 L format photo size (127 mm) and W6 is an A5 size (148 mm).

Furthermore, W7 is a B5 size (182 mm), W8 is a reciprocating postcard size (200 mm), W9 is a 8×10 format (dividing into six) photo size (203.2 mm), W10 is an A4 size (210 mm) and W11 is a Letter size (215.9 mm). In addition, in FIG. 5, only left sides of W1 to W11 are illustrated from the center position Xc in the paper width direction for the sake of the convenience and right sides thereof are bilaterally symmetrical with the position Xc as the center. In addition, the transport driven roller 25 may be arranged bilaterally symmetrical with the center position Xc. Furthermore, the transport driven roller 25 may be arranged at regular intervals.

As illustrated in FIG. 5, the concave and convex engaging section 40 is provided in the region coming into contact with various standard sized sheets of paper which are expected to be used in the printer 1. In a case of a so-called center feeding, it is preferable that the concave and convex engaging section 40 be arranged close to the center of the transportation path of the paper and in a case of feeding the paper close to one side thereof, it is preferable that the concave and convex engaging section 40 be arranged close to one side of the transportation path, which is the same side as feeding the paper. In particular, a concave and convex engaging section illustrated in a reference numeral 40B is provided in a region coming into contact with the paper of all sizes. A concave and convex engaging section illustrated with a reference numeral 40A is provided in a region coming into contact with the paper having widths equal to or greater than the width W7. Then, two concave and convex engaging sections 40 are arranged at positions which do not come into contact with both end portions (the edges of the paper) of the paper of all sizes.

As described above, it is possible to further improve the mechanical bonding strength by arranging the concave and convex engaging section 40 when forming the transport driving roller 24 by bending the plate material T, compared to a configuration in which the concave and convex engaging section is provided only outside the region coming into contact with the paper. As a result, it is possible to obtain the roller having low distortion or deflection and since the transportation is performed with high accuracy, it is possible to obtain favorable recording quality.

Then, since the concave and convex engaging section 40 is arranged in the position which does not come into contact with both ends of the paper, a corner portion of the front end of the paper particularly can be prevented from being caught in the gap 44 of the concave and convex engaging section 40, when the front end of the paper passes through the transport driving roller 24. According to the above description, it is possible to provide a printer including the transport driving roller 24 which can realize further high accuracy or high reliability while still maintaining a smooth transportation of the paper.

Furthermore, in the embodiment, the concave and convex engaging section 40 is at a position coming into contact with the paper and is arranged at the position which does not come into contact with the transport driven roller 25 as clearly illustrated from FIG. 5. Therefore, the concave and convex engaging section 40 can be prevented from giving damage to the peripheral surface of the transport driven roller 25. In addition, the concave and convex engaging section 40 does not give the damage to the paper by coming into a strong contact with the paper when the paper is nipped by the transport driving roller 24 and the transport driven roller 25.

In addition, the concave and convex engaging sections 40 (40A and 40B) arranged in the left side region from the center position Xc of the paper in FIG. 5; however, even in the left side region of the paper, the concave and convex engaging section 40 can be provided at, for example, two positions which avoid the transport driven roller 25 and the end portion of the paper in the region coming into contact with the paper. Furthermore, the concave and convex engaging section may be provided outside the region coming into contact with the paper in addition to in the region coming into contact with the paper.

Second and Third Embodiments

Subsequently, second and third embodiments of the concave and convex engaging section will be described with reference to FIG. 6 and FIGS. 7A and 7B. The same reference numerals are assigned to the configuration described above in FIG. 6 and FIGS. 7A and 7B, and description thereof will be omitted.

First, a concave and convex engaging section 50 according to the third embodiment illustrated in FIGS. 6 and 7A is formed such that gaps (illustrated in reference numerals 54*a* and 54*b*) formed between a bottom portion of a concave section 51 and a top portion of a convex section 52 are extended in a direction intersecting with the rotation axis direction.

Particularly, the concave and convex engaging section 50 is formed such that the gap formed between the bottom portion of the concave section 51 and the top portion of the convex section 52 forms a V shape. As described above, since the gap formed between the bottom portion of the concave section 51 and the top portion of the convex section 52 is extended in the direction intersecting with the rotation axis direction, the front end of the paper is unlikely to be caught in the gap of the concave and convex engaging section 50 and further smooth transportation can be realized.

In addition, if the concave and convex engaging section 50 is positioned at a position facing the transport driven roller 25, the paper is pushed into the gap when the paper is nipped between the concave and convex engaging section 50 and the transport driven roller 25; however, the gap is configured to form the V shape so that the paper is unlikely to be pushed into the gap and the damage to the paper is reduced. In addition, since the gap formed between the bottom portion of the concave section 51 and the top portion of the convex section 52 is extended in the direction intersecting with the rotation axis direction, the damage to the transport driven roller 25 can be reduced.

Furthermore, in the embodiment, the v-shaped gap formed between the top portion of the convex section 52 and the bottom portion of the concave section 51 is formed in a direction in which the V-shaped front end is rotated when a transport driving roller (a reference numeral 24A is assigned in the embodiment) is rotated in the rotation direction in which the paper is transported to the upstream side (an arrow direction a in FIG. 7A). Then, the side end of the paper P having a predetermined size passes through a gap 54*a* that is a side of two sides of gaps 54*a* and 54*b* configuring the V-shaped gap formed between the convex section 52 and the concave section 51, and that is positioned in the outside direction of the paper.

Accordingly, the gap 54*a* acts to push aside the corner portion of a front end of the paper to the outside (the left side in FIGS. 7A and 7B) and the corner portion of the front end of the paper can be prevent from being caught into the gap 54*a* of the corner portion of the front end of the paper due to the shape and the arrangement of the V-shaped gap even though the corner portion of the front end of the paper enters into the gap 54*a* when the transport driving roller 24A is reverse rotated.

On the other hand, FIG. 7B illustrates a concave and convex engaging section 50' according to an embodiment (the third embodiment) in which the V-shaped direction is arranged in the opposite direction to the second embodiment described above. In the embodiment, when a transport driving roller (a reference numeral 24B is assigned in the embodiment) is rotated in the rotation direction in which the paper is transported to the upstream side (an arrow direction a in FIG. 7B), the V-shaped front end is formed to direct to the opposite direction to the rotation direction. Then, the side end of the paper P having a predetermined size passes through a gap 54*b*' that is a side of two sides of gaps 54*a*' and 54*b*' configuring the V-shaped gap, which is a side positioned in the inner side of the paper.

Accordingly, the gap 54*b*' acts to push aside the corner portion of the front end of the paper to the outside (the left side in FIG. 7) and the corner portion of the front end of the paper can be prevent from being caught into the gap 54*b*' due to the shape and the arrangement of the V-shaped gap even though the corner portion of the front end of the paper enters into the gap 54*b*' when the transport driving roller 24B is reverse rotated (an arrow direction a).

Fourth and Fifth Embodiments

Subsequently, fourth and fifth embodiments of the concave and convex engaging section will be described with reference to FIGS. 8A and 8B. A concave and convex engaging section 60 according to the fourth embodiment illustrated in FIG. 8A is configured to include a convex section 62 formed in a direction in which the front end thereof moves in a reverse direction when a transport driving roller (a reference numeral 24C is assigned in the embodiment) is rotated in the reverse direction (an arrow direction a) and a concave section 61 engaging with the convex section 62.

A gap 64 is formed to extend in the direction intersecting with the rotation axis direction of the roller (the x-direction) by the convex section 62 and the concave section 61. The gap 64 is formed along a direction to push and displace the corner portion of the front end of the paper to the outside when the transport driving roller 24C is reverse rotated so that the corner portion of the front end of the paper can be prevent from being caught into the gap 64.

In addition, similarly, a concave and convex engaging section 60' according to the fifth embodiment illustrated in FIG. 8B is configured to include the convex section 62 formed with its front end facing a direction opposite to the reverse direction when a transport driving roller (a reference numeral 24D is assigned in the embodiment) is rotated in the reverse direction (the arrow direction a) and a concave section 61 engaging with the convex section 62.

Then, a gap 64' is formed to extend in the direction intersecting with the rotation axis direction of the roller (the x-direction) by the convex section 62 and the concave section 61. The gap 64' is formed along a direction to push aside the corner portion of the front end of the paper to the outside when the transport driving roller 24D is reverse rotated so that the corner portion of the front end of the paper can be prevent from being caught into the gap 64.

It goes without saying that each of the embodiments described above is an example and the invention is not limited to the embodiments. For example, the gap configuring the concave and convex engaging section may be a curved shape in addition to the linear shape. In addition, the concave and convex engaging sections according to each of the embodiments described above may be used by combining with each other. The roller applying each of the concave and convex engaging sections is not limited to the transport driving roller 24 and can be applied to a roller which is provided on another paper transporting path or may be applied to a shaft axis besides the paper transporting roller.

Other Characteristics of Printer

Figure 11:
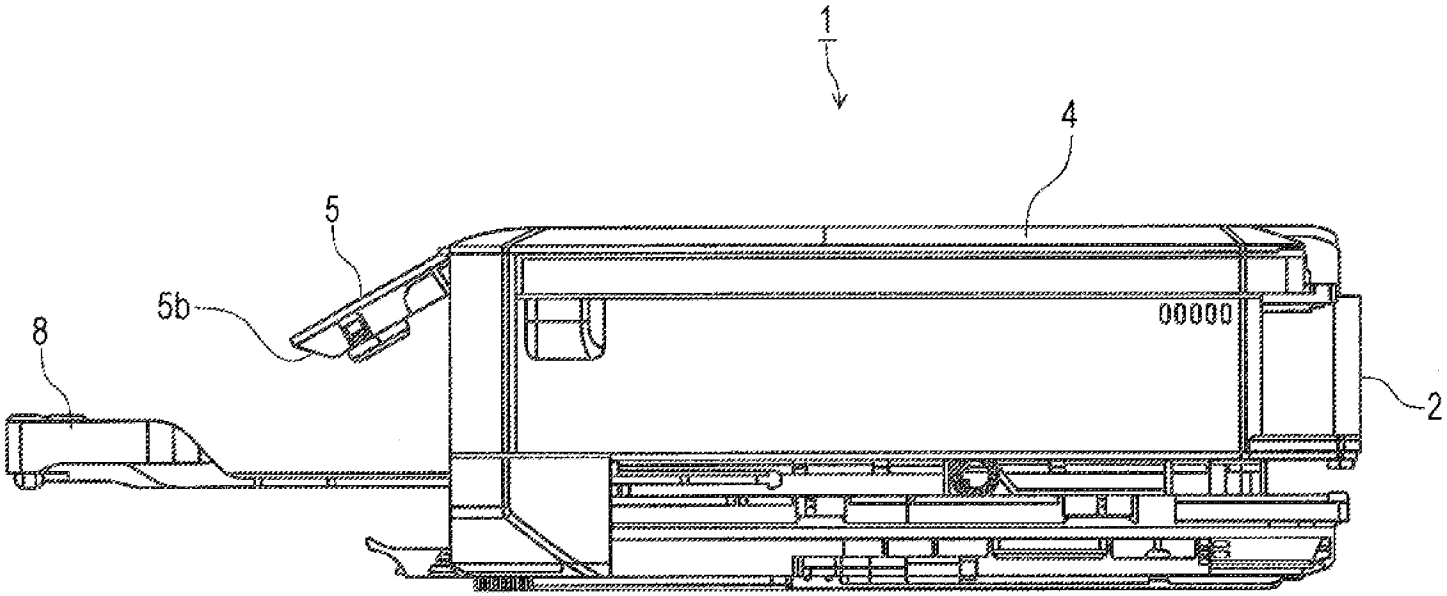
FIG. 11 is a side view of the printer according to the invention.
Figure 13:
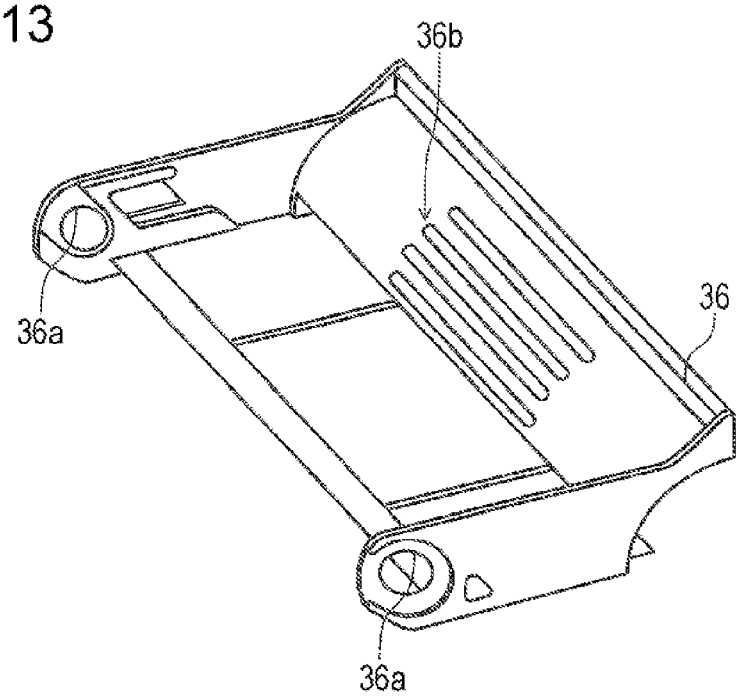
FIG. 13 is a perspective view of a cover provided in a lower side tray.
Figure 14:
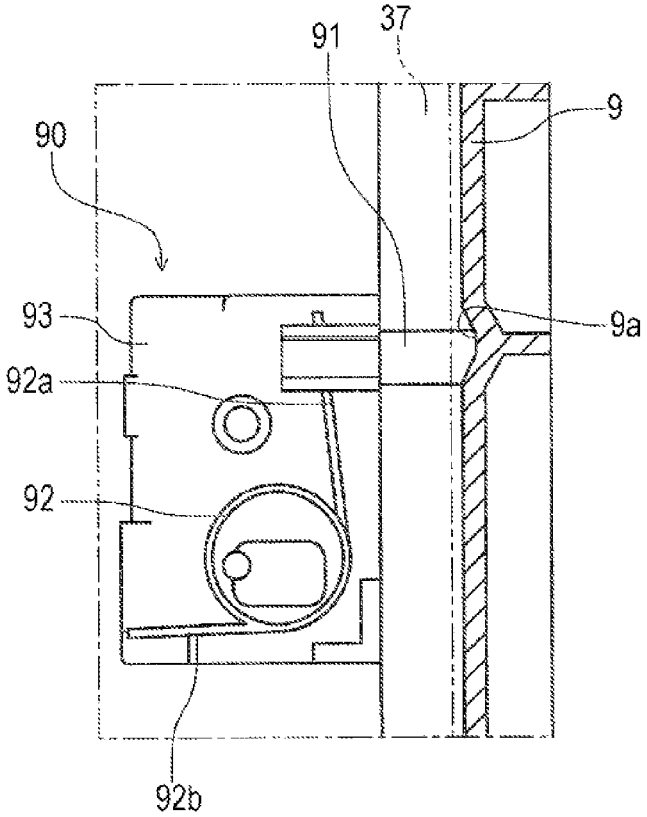
FIG. 14 is a plan view (a partial cross-sectional view) of a holding mechanism which holds an upper side tray in a predetermined position.
Figure 15:
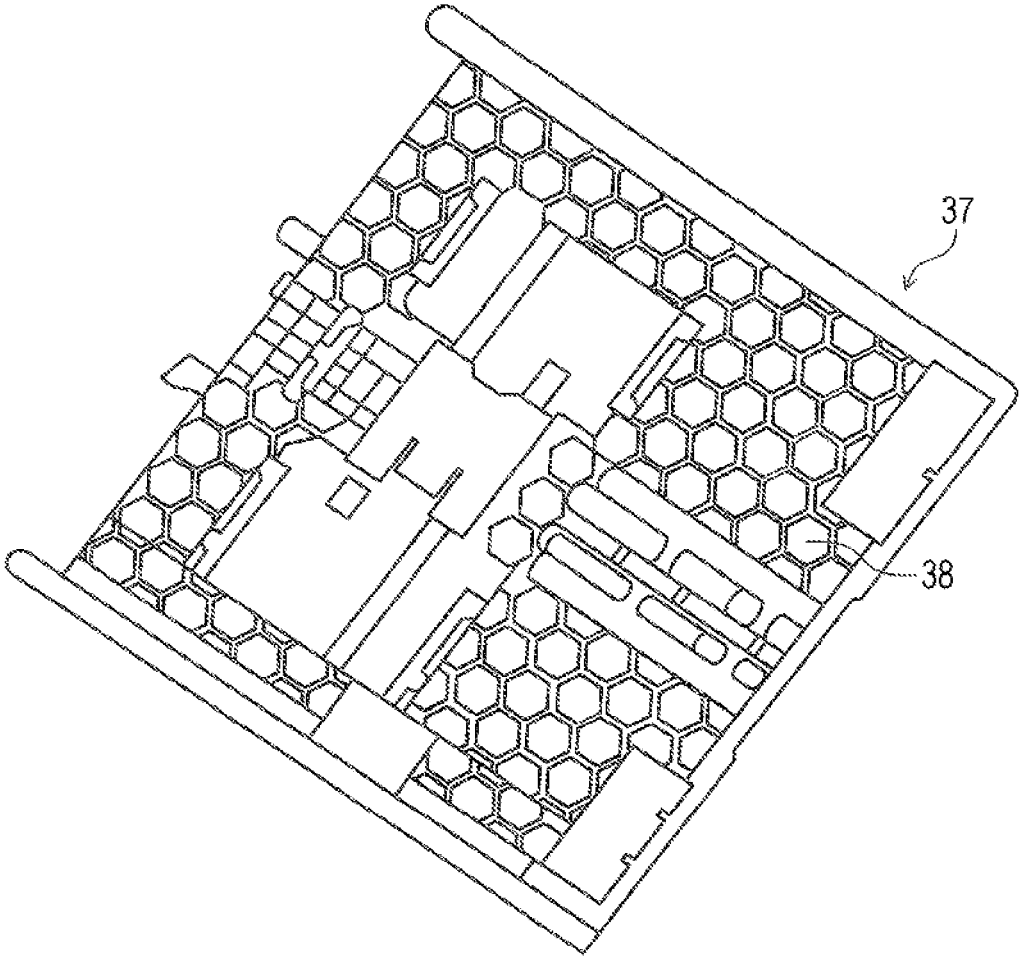
FIG. 15 is a perspective view of the upper side tray viewed from a lower side thereof.
Figure 16:
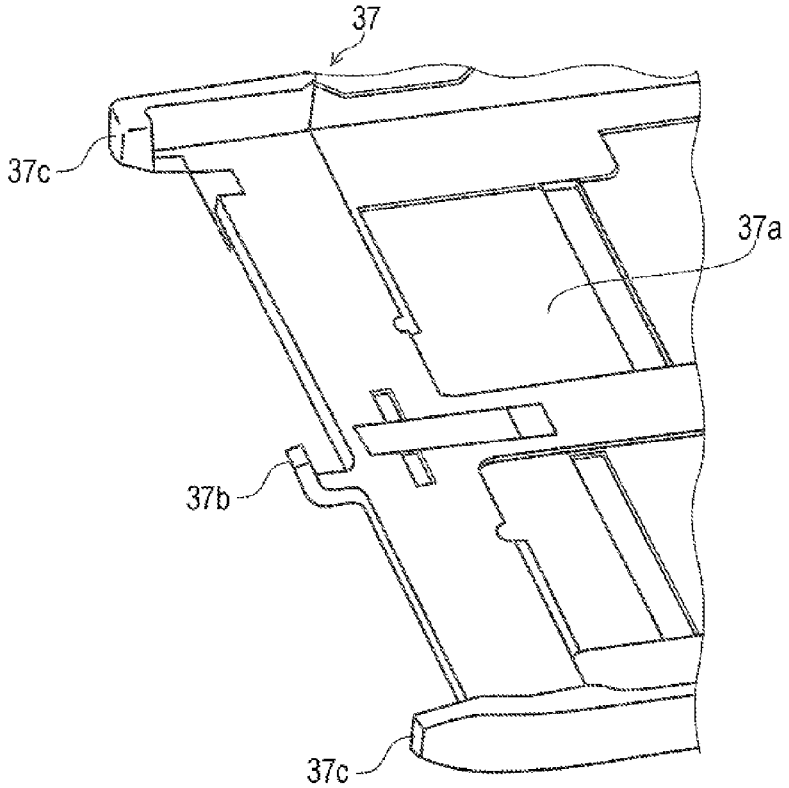
FIG. 16 is a perspective view of a front end portion of the upper side tray.
Figure 17:
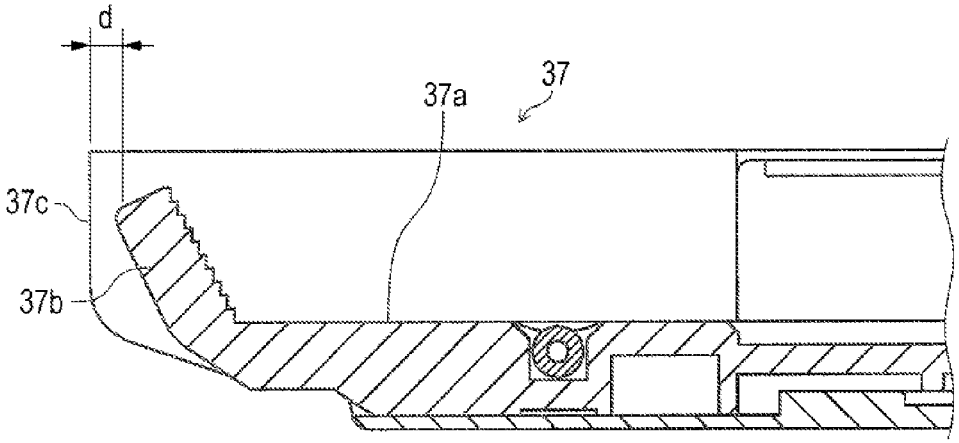
FIG. 17 is a side cross-sectional view of the front end portion of the upper side tray.
Figure 18:
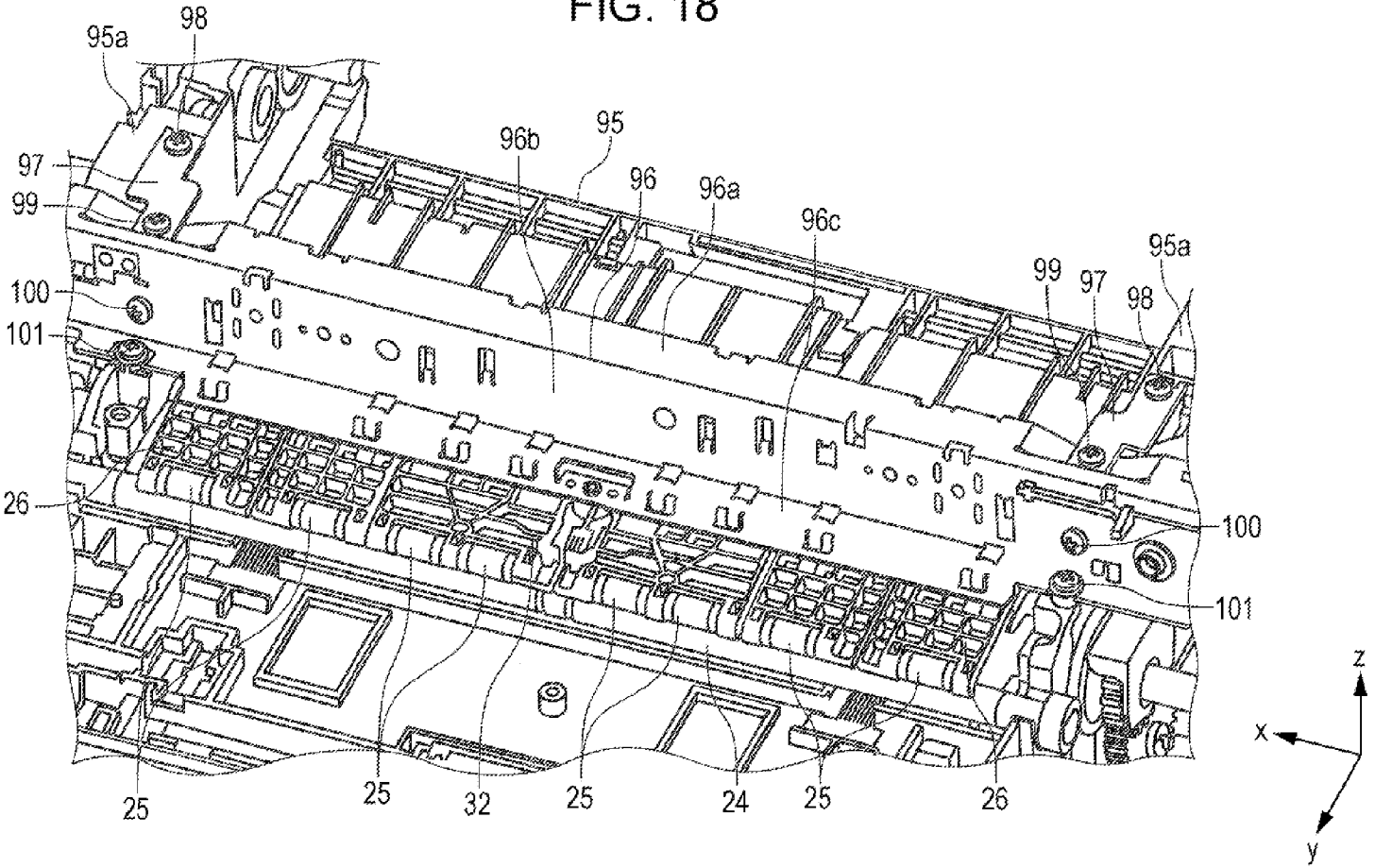
FIG. 18 is a perspective view of a frame configuring a base body of the printer according to the invention.
Figure 19:
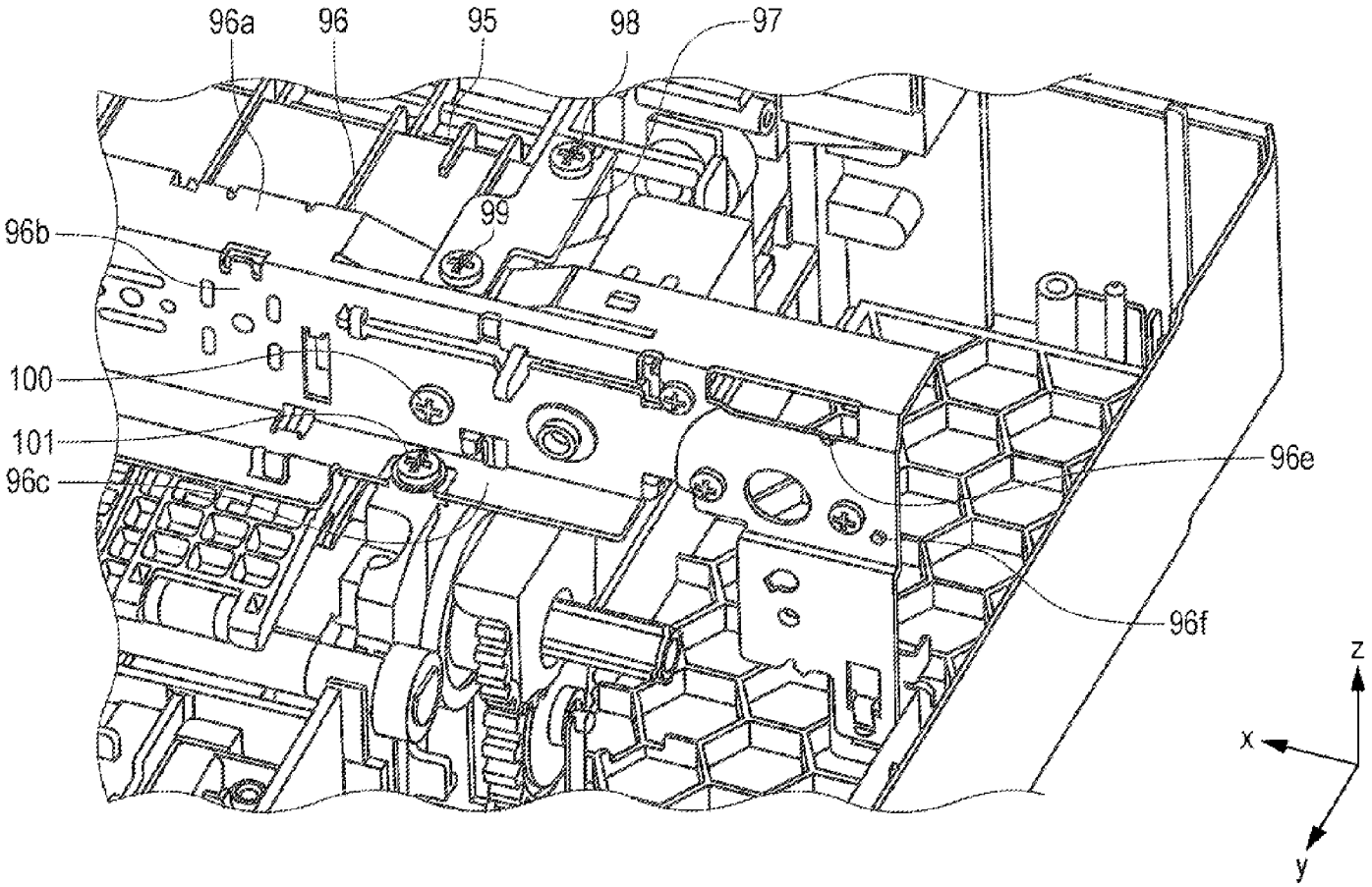
FIG. 19 is a partially enlarged perspective view of the frame configuring the base body of the printer according to the invention.
Figure 20:
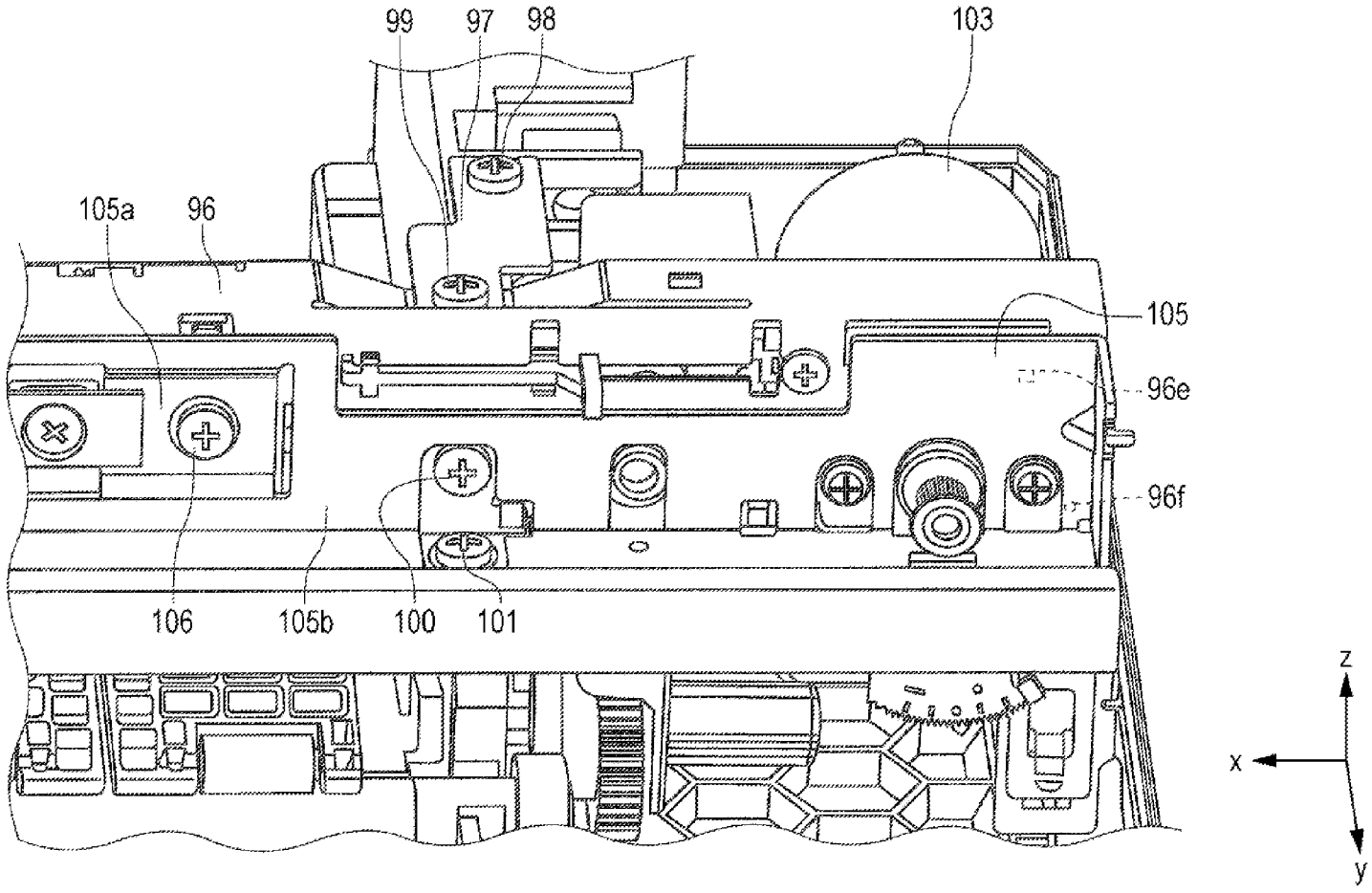
FIG. 20 is a partially enlarged perspective view of the frame configuring the base body of the printer according to the invention.

Subsequently, other characteristics of the printer 1 according to the invention will be described with reference to FIGS. 11 to 20. FIG. 11 is a side view of the printer 1, FIG. 12 is a perspective view of the printer 1, FIG. 13 is a perspective view of the cover 36 provided in a lower side tray 35, FIG. 14 is a plan view (a partial cross-sectional view) of a holding mechanism 90 which holds an upper side tray 37 in a predetermined position, FIG. 15 is a perspective view of the upper side tray 37 viewed from a lower side thereof, FIG. 16 is a perspective view of a front end portion of the upper side tray 37, FIG. 17 is a side cross-sectional view of the front end portion of the upper side tray 37, FIG. 18 is a perspective view of a frame 96 configuring a base body of the printer 1, FIG. 19 is a partially enlarged perspective view of the frame 96, and FIG. 20 is a partially enlarged perspective view of the frame 96 and a guide frame 105 configuring the base body of the printer according to the invention.

FIG. 11 illustrates characteristics of the operation panel 5. The lower end surface 5*b* of the operation panel 5 is formed in a sloped shape. The sloped shape is provided not to interfere the corner portion of the lower end of the operation panel 5 (the lower end corner portion of the inner side of the apparatus) in a state where the operation panel 5 is open in a predetermined angle, when the paper discharged on the discharged-paper receiving tray 8 is taken out. In particular, this is effective when such a work to drawn out the paper is performed, because a hand is necessary to insert to the lower side of the operation panel 5 in a case where the paper in a small size is taken out.

Figure 12:
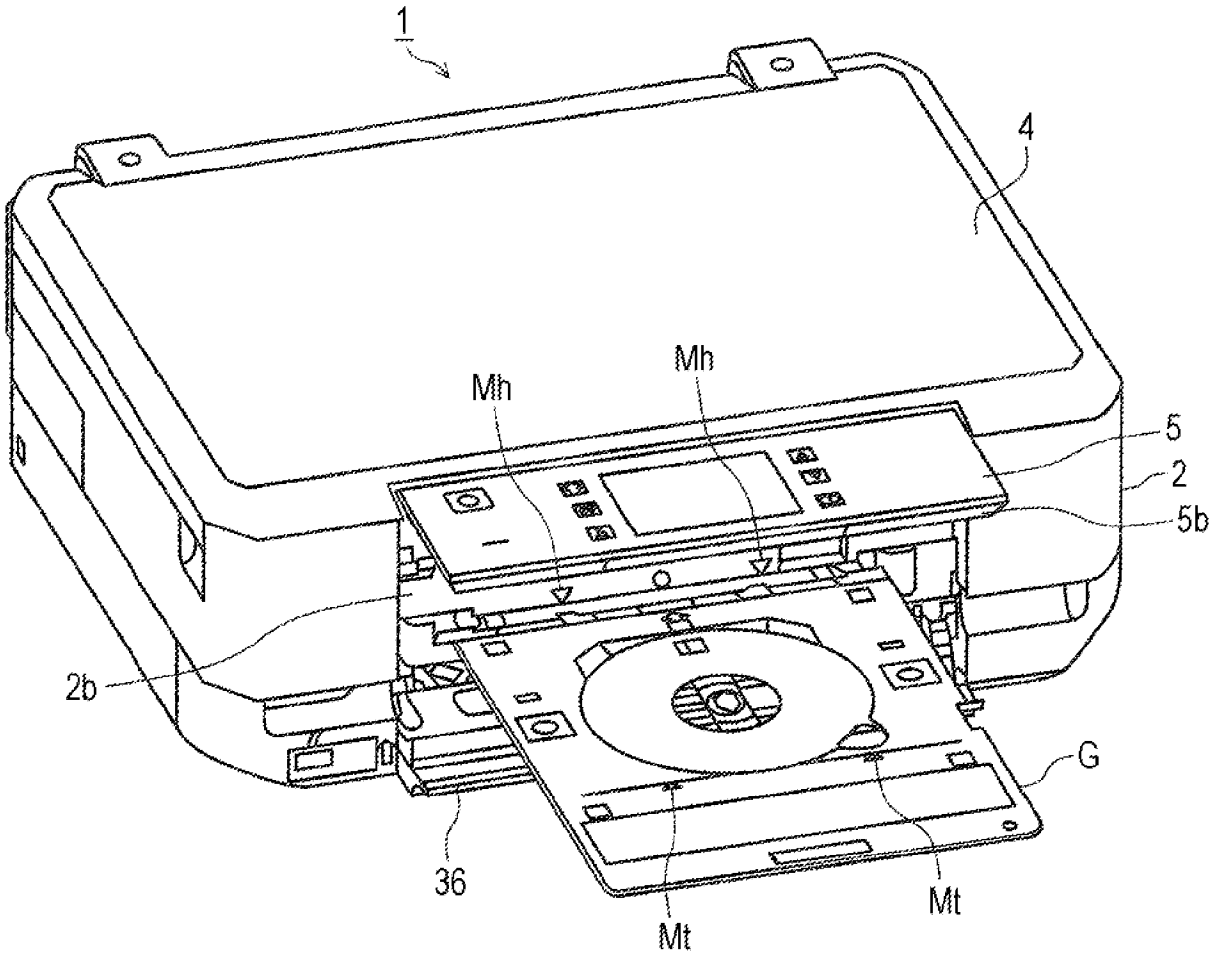
FIG. 12 is a perspective view of the printer according to the invention.

Subsequently, FIG. 12 illustrates characteristics of a portion into which a tray G capable of setting a disk is inserted. The printer 1 is configured to perform the ink jet recording on the recording medium such as an optical disk. The discharged-paper receiving tray 8 also includes a guide function for guiding the tray G and a user inserts the tray G setting the recording medium such as the optical disk into the inside of the apparatus via the discharged-paper receiving tray 8.

At this time, the user aligns a position mark Mt provided in the tray G and a position mark Mh provided in the front surface 2*b* of the apparatus body. Here, the position mark Mt and the position mark Mh are provided in two places placed by a predetermined gap in the width direction of the apparatus. Thus, when the user sets the tray G with respect to the discharged-paper receiving tray 8, it can be prevented that the tray G is set in an inclined way.

Subsequently, FIG. 13 is a perspective view of the cover 36 provided in the lower side tray 35. The cover 36 is rotatably provided in the lower side tray 35 as described above. The lower side tray 35, the upper side tray 37 and the discharged-paper receiving tray 8 can be exposed by opening the cover 36. Attachment and detachment work of the lower side tray 35 or the upper side tray 37 or slide operation of the discharged-paper receiving tray 8 can be performed. In addition, a reference numeral 36*a* is a bearing hole engaging with a rotation shaft (not illustrated) provided in the apparatus body.

Then, since the cover 36 is a gripping section when drawing out the lower side tray 35 in a state of being open (FIG. 2), it is possible to draw out the lower side tray 35 with good operability. Then, a concave-convex shaped grip section 36*b* is formed inside the cover 36 so that grip performance is intended to be improved when the cover 36 is gripped. Furthermore, since the cover 36 also serves as the cover function and the grip function, it is possible to reduce a dimension of the depth direction of the apparatus.

In addition, when the discharged-paper receiving tray 8 protrudes from a storage state toward an advanced state in a closed state of the cover 36, the discharged-paper receiving tray 8 abuts the cover 36 and then the cover 36 is open. In other words, since the discharged-paper receiving tray 8 lets the cover 36 open even though the user does not open the cover 36 when the recording is performed, paper jam can be prevented and the user can omit the opening operation of the cover 36. In addition, there is no need to separately provide a mechanism for automatically opening the cover 36, thereby preventing complexity of the apparatus and an increase in cost.

Subsequently, FIG. 14 illustrates the holding mechanism 90 which holds the upper side tray 37 in a predetermined position. A reference numeral 9 is a guide section guiding the upper side tray 37, which is formed on a frame material (the entire thereof is not illustrated) configuring the base body of the printer 1. The guide section 9 guides the right side of the upper side tray 37 viewed from the front side of the apparatus. The guide section 9 has a concave section 9*a* and a holding member 91 configuring the holding mechanism 90 provided in the upper side tray 37 enters the concave section 9*a* so that the upper side tray 37 is held in a predetermined position. Furthermore, the predetermined position described in here is, for example, the position of the upper side tray 37 in a state where, for example, the upper side tray 37 is pushed into the printer 1 and the above described cover 36 can be closed.

The holding mechanism 90 includes a coil spring 92, an end 92*b* of the coil spring 92 engages with a base member 93, and the other end 92*a* biases a lock member 91 toward the guide section 9. The upper side tray 37 is held in a predetermined position by the holding mechanism 90 configured as described above. Furthermore, the holding described in here is holding (holding enough to cause a click feeling) in the embodiment enough to determine a defined position of insertion with respect to the user when the user inserts the upper side tray 37 into the apparatus body. A holding force is exerted not to interfere the operation when the slide operation of the upper side tray 37 is performed along the delivery direction of the paper by a driving mechanism (not illustrated).

Subsequently, FIG. 15 illustrates a characteristic configuration of a bottom portion of the upper side tray 37. A plurality of concave-shaped sections 38 are formed on the bottom portion of the upper side tray 37. By forming a plurality of concave-shaped sections 38 on the bottom portion of the upper side tray 37, the user can obtain a good grip performance even though the user grips any position of the upper side tray 37. In particular, the upper side tray 37 can be easily drawn out even when the upper side tray 37 enters the inside of the apparatus body.

Subsequently, FIGS. 16 and 17 illustrate characteristic configurations of the front end section of the upper side tray 37. The front end portion of the upper side tray 37 has protrusion sections 37*c* at both of the end portions in the width direction thereof and a paper front end regulating section 37*b* at the center position in the width direction thereof. The paper front end regulating section 37*b* is a protrusion which regulates the front end portion of the paper placed on a tray bottom surface 37*a*. If the paper front end regulating section 37*b* is damaged when the user drops the upper side tray 37, the function of the upper side tray 37 is damaged (the paper which is set easily drops).

Then, the protrusion sections 37*c* are provided on both sides of the front end portion of the upper side tray 37 and the protrusion sections 37*c* are formed to protrude to the front end side from the paper front end regulating section 37*b* as illustrated in FIG. 17 (a dimension d). Accordingly, the paper front end regulating section 37*b* can be protected and damage from the drop to the paper front end regulating section 37*b* can be prevented.

Subsequently, a frame structure configuring the base body of the printer 1 will be described with reference to FIGS. 18 to 20. A reference numeral 96 in FIG. 18 is a frame provided on rear side of a carriage 29 and is formed by bending of a metal material, and has a form extending in the x-direction. A motor 103 (FIG. 20) driving the carriage 29, a guide frame 105 supporting and guiding the carriage 29 in the x-direction or the like is assembled in the frame 96. Furthermore, FIGS. 18 and 19 illustrate a state where the guide frame 105 is removed from the frame 96 for convenience of description.

In addition, a reference numeral 95 in FIG. 18 is a resin frame. Each configuration element of the printer 1 is assembled in the resin frame 95 and the frame 96 described above is also assembled in the resin frame 95. The frame 96 is fixed to the resin frame 95 at a plurality of locations. In particular, the frame 96 is fixed to frame mounting sections 95*a* and 95*a* provided on both sides of the resin frame 95 in the rear side thereof via mounting plates 97. The mounting plates 97 are fixed by screws 98 on the resin frame 95 side and screws 99 on the frame 96 side, respectively. The screws 99 fix an upper surface 96*a* (a surface parallel to an x-y plane) of the frame 96.

Furthermore, the frame 96 fixes a vertical wall surface 96*b* (a surface parallel to an x-z plane) to the resin frame 95 on both sides in the x-direction by screws 100. Furthermore, the frame 96 fixes a lower surface 96*c* (a surface parallel to an x-y plane) to the resin frame 95 in both sides in the x-direction by screws 101. As described above, the frame 96 is fixed to the resin frame 95 at six locations on both sides, that is, three locations on one side in the x-direction. Accordingly, the frame 96 is suppressed from varying with respect to the resin frame 95 and, in particular, a gap between the recording head 30 and the support member 28 (FIG. 2) which supports the paper at a position facing the recording head 30 is suppressed from changing, thereby obtaining a good recording result.

Furthermore, the guide frame 105 which supports and guides the carriage 29 in the x-direction is fixed to the frame 96 by a screw 106 as illustrated in FIG. 20. In addition, only the fixing section of the right side in the x-direction is illustrated in FIG. 20; however, similarly, the guide frame 105 is fixed by the screw also in the left side in the x-direction although not illustrated in the drawing. Here, a fixed section 105*a* which is fixed to the guide frame 105 by the screws is formed to be dented in the inside of the apparatus. Accordingly, a gap is formed between the other vertical wall surface section 105*b* and the vertical wall surface 96*b* of the frame 96.

However, protrusion sections 96*e* and 96*f* are formed at the right end of the vertical wall surface 96*b* of the frame 96 and the protrusion sections 96*e* and 96*f* abut a rear surface side of the vertical wall surface section 105*b* of the guide frame 105 when the guide frame 105 is mounted. Thus, independent two plate metals, that is, the frame 96 and the guide frame 105 can be firmly connected to each other, deformation of the guide frame 105 is effectively prevented, and a proper recording quality can be maintained, for example, even if the printer 1 is dropped.

Subsequently, other characteristic configurations on the paper transporting path will be described. First, returning to FIG. 2, the paper delivery position (in particular, an upper end position 14*a* of a separation slope 14) from the lower side tray 35 and the upper side tray 37 is positioned further on the inside (the left side in FIG. 2) of the apparatus from the paper nip position by a reverse roller 17 and a driven roller 19 in the Y direction, that is, the inside direction of the apparatus. In other words, the paper which is delivered from the lower side tray 35 or the upper side tray 37 directs to the paper nip position by the reverse roller 17 and the driven roller 19 to take a so-called overhang posture. The dimension in the inside direction of the apparatus can be decreased by configuring such a paper transporting path.

Furthermore, a paper detecting sensor 15 which detects passing of the front end of the paper is provided between an upper end position 14*a* of the separation slope 14 and the paper nip position by the reverse roller 17 and the driven roller 19 (hereinafter, the paper feeding zone is referred to as "first feeding zone" for convenience of description). A first feeding zone can be set lengthily by providing the paper detecting sensor 15 in this position.

Hereinafter, the process will be described in detail. First, if a total amount of rotation of the feeding roller 10 exceeds an equivalent amount of the paper length when the paper is delivered by a feeding roller 10, the total amount of the rotation of the feeding roller 10 has to be set on a safe side, considering the length of the paper in order to deliver the next paper. Furthermore, there is a concern that a transportation load may occur when the front end of the paper passes through the separation slope 14 and then slip may occur between the feeding roller 10 and the paper. In other words, when considering the slip on the limitation of the total amount of the rotation of the feeding roller 10, the first feeding zone has to be set short. Otherwise, the front end of the paper cannot reach the paper nip position by the reverse roller 17 and the driven roller 19. Then, when the first feeding zone is short, the paper storage tray cannot be multi-tray or the number of sheets of paper which is set in each tray has to be reduced.

However, the position of the rear end of the paper, just before the front end of the paper reaches the paper nip position by the reverse roller 17 and the driven roller 19 can be nipped by providing the paper detecting sensor 15 which detects the passing of the front end of the paper in the first feeding zone, in particular, in the vicinity of the upstream of the paper nip position by the reverse roller 17 and the driven roller 19. In other words, it is not necessary to provide the limitation in the amount of the rotation of the feeding roller 10 in advance considering the length of the paper and then the first feeding zone can be set lengthily.

In addition, when the paper is an rectangular shape, a short side of the paper may be transported as the front end in the transportation direction and a long side thereof may be transported as the front end in the transportation direction.

The transport driving roller 24 of the invention uses the cylindrical shaft which is formed with the press processing; however, the method for providing the cylindrical shaft may be processing other than the press processing and the cylindrical shaft may be a steel pipe such as an electric resistance welded pipe.

The entire disclosure of Japanese Patent Application No. 2012-175757, filed Aug. 8, 2012 is expressly incorporated by reference herein.

What is claimed is:

1. A recording apparatus comprising:

a transporting roller includes a cylindrical shaft having two spaced apart end portions and having one joint extending between the two end portions of the shaft and transports a recording medium by being driven to rotate;

a driven roller which holds and transports the recording medium with the transporting roller; and a recording section which performs recording on the recording medium, wherein the joint includes protrusion sections which protrude in a direction intersecting with an axial direction of the transporting roller, wherein the joint has a recess section in a position which is connected to an end portion of an opposite side to a protruding direction of each of the protrusion sections.

2. The recording apparatus according to claim 1, wherein the joint has a gap in the most protruding part of the protrusion section in the axial direction.

3. The recording apparatus according to claim 2, wherein the first gap is provided to extend in a direction intersecting with the axial direction of the transporting roller.

4. The recording apparatus according to claim 3, wherein the joint has a gap in a position which is connected to an end portion of an opposite side to a protruding direction of the protrusion section.

5. The recording apparatus according to claim 4, wherein the plurality of protrusion sections are provided in a region which comes into contact with the recording medium in the transporting roller.

6. The recording apparatus according to claim 2, wherein the plurality of protrusion sections are provided in a region which comes into contact with the recording medium in the transporting roller.

7. The recording apparatus according to claim 3, wherein the plurality of protrusion sections are provided in a region which comes into contact with the recording medium in the transporting roller.

8. The recording apparatus according to claim 1, wherein the plurality of protrusion sections are provided in a region which comes into contact with the recording medium in the transporting roller.

9. The recording apparatus according to claim 1, wherein the plurality of protrusion sections are provided in a region which comes into contact with the recording medium in the transporting roller.

* * * * *